US005875843A

United States Patent [19]

Hill

[11] Patent Number: 5,875,843

[45] Date of Patent: Mar. 2, 1999

[54] METHOD FOR VERTICALLY EXTENDING A WELL

[76] Inventor: Gilman A. Hill, 7128 S. Poplar La., Englewood, Colo. 80112

[21] Appl. No.: 680,564

[22] Filed: Jul. 12, 1996

[51] Int. Cl.[6] ..... E21B 47/00

[52] U.S. Cl. ..... 166/250; 166/308; 166/281

[58] Field of Search ..... 166/308, 280, 166/281, 250.1, 271

[56] References Cited

U.S. PATENT DOCUMENTS

| | | | |
|---|---|---|---|
| 2,693,854 | 11/1954 | Abendroth | 166/15 |
| 2,838,117 | 6/1958 | Clark, Jr. et al. | 166/42 |
| 2,848,052 | 8/1958 | Stinson | 166/42 |
| 2,851,109 | 9/1958 | Spearow | 166/177 |
| 2,935,129 | 5/1960 | Allen et al. | 166/42 |
| 3,032,104 | 5/1962 | O'Reilly | 166/35 |
| 3,139,139 | 6/1964 | Elkins | 166/42 |
| 3,280,912 | 10/1966 | Sheffield, Jr. | 166/29 |
| 3,428,129 | 2/1969 | Cook | 166/292 |
| 3,730,276 | 5/1973 | Land | 166/314 |
| 3,825,071 | 7/1974 | Veatch, Jr. | 166/308 |
| 3,878,884 | 4/1975 | Raleigh | 165/1 |
| 3,965,982 | 6/1976 | Medlin | 166/249 |
| 4,068,718 | 1/1978 | Cooke, Jr. et al. | 166/280 |
| 4,078,609 | 3/1978 | Pavlich | 166/271 |
| 4,109,721 | 8/1978 | Slusser | 166/280 |
| 4,186,802 | 2/1980 | Perlman | 166/280 |
| 4,391,337 | 7/1983 | Ford et al. | 175/4.6 |
| 4,456,069 | 6/1984 | Vigneri | 166/303 |
| 4,633,951 | 1/1987 | Hill et al. | 166/308 |
| 4,640,355 | 2/1987 | Hong et al. | 166/269 |
| 4,678,037 | 7/1987 | Smith | 166/299 |
| 4,683,943 | 8/1987 | Hill et al. | 166/63 |
| 4,687,061 | 8/1987 | Uhri | 166/308 |
| 4,714,115 | 12/1987 | Uhri | 166/308 |
| 4,718,493 | 1/1988 | Hill et al. | 166/308 |
| 4,823,875 | 4/1989 | Hill | 166/280 |
| 4,869,322 | 9/1989 | Vogt et al. | 166/280 |
| 4,887,670 | 12/1989 | Lord et al. | 166/281 |
| 4,893,676 | 1/1990 | Hill | 166/280 |
| 4,917,188 | 4/1990 | Fitzpatrick, Jr. | 166/295 |
| 4,938,286 | 7/1990 | Jennings, Jr. | 166/280 |
| 5,036,918 | 8/1991 | Jennings, Jr. et al. | 166/263 |
| 5,036,919 | 8/1991 | Thomas et al. | 166/271 |
| 5,056,598 | 10/1991 | Jennings, Jr. | 166/308 |
| 5,159,979 | 11/1992 | Jennings, Jr. | 166/280 |
| 5,161,618 | 11/1992 | Jones et al. | 166/308 |
| 5,273,115 | 12/1993 | Spafford | 166/281 |
| 5,295,545 | 3/1994 | Passamaneck | 166/299 |
| 5,314,020 | 5/1994 | Jennings, Jr. et al. | 166/281 |
| 5,355,802 | 10/1994 | Petitjean | 102/313 |
| 5,417,287 | 5/1995 | Smith et al. | 166/308 |

*Primary Examiner*—Roger J. Schoeppel
*Attorney, Agent, or Firm*—Sheridan Ross P.C.

[57] ABSTRACT

The present invention is a method for fracturing a zone to collect fluids from the zone through a wellbore. The method introduces into the wellbore a series of fracturing fluids to fracture the sediments either above or below the bottom of the wellbore. A fracture extends from the wellbore into the sediments which can include a plurality of producing zones.

46 Claims, 19 Drawing Sheets

DEPTH, FT
8,000
9,500
10,000
10,500
11,000
11,500
12,000
12,500
DISTANCE, 500 FT
66
144a
144b
144c
136
140
130
160
124
128
132
120

78
120
200
188

8,000
8,200
8,400
8,600
8,800
9,000
9,200
9,400
9,600
9,800
10,000
10,200
10,400
10,600
10,800
11,000
11,200
DEPTH, FT.
DISTANCE, 250 FT.

METHOD FOR VERTICALLY EXTENDING A WELL

The present application claims priority from copending U.S. Provisional application Ser. No. 60/001,146 entitled "METHOD FOR VERTICALLY EXTENDING A WELL", filed Jul. 14, 1995, which is incorporated herein by reference in its entirety.

FIELD OF THE INVENTION

The present invention relates generally to a method for completing wells that collect fluids from a subterranean zone and, particularly, to a method for fracturing a subterranean zone for oil and/or gas production.

BACKGROUND OF THE INVENTION

The conventional process to produce fluids, such as oil and/or gas, from one or more subterranean zones is to drill a well into the zones. The zones are hydraulically fractured to increase the zone's permeabilities by providing fractures in the zones along which fluids can travel. The increased permeabilities increase the recovery of oil and/or gas by the well.

The process of hydraulically fracturing a target zone is composed of numerous steps. In the most common process, the steps include cementing a production casing in a well, loading an explosive device such as a perforating gun, lowering the device into the well by a wireline or similar device to the depth of the target zone, perforating the production casing in the well by triggering the explosive device, introducing a fluid into the target zone through the perforations to hydraulically fracture the target zone, and introducing a proppant into the fracture to restrict closure of the fracture after the fluid is removed from the well. The lengths of the fractures are typically limited to the target zone to prevent undesired fluids from other zones from flowing into the target zone along the fractures, to prevent the loss of the desired fluid into adjacent thief zones, and to prevent the commingled production of fluids from different zones. Thus, the casing is cemented in the wellbore not only for wellbore support but also to isolate the target zone from other zones. This technique is especially adapted for use in fracturing discrete, continuous zone-type deposits of the type shown in FIG. 1 from the well 50. The sandstone layer 54 *a,b* in such deposits is relatively thin (e.g., less than 200 feet) and is therefore easily targeted for fracturing by this technique.

The technique is not effective in recovering oil and/or gas from thick deposits, such as many tight-sands gas deposits. Gas contained in such deposits is much more difficult to recover than the gas in the continuous zone-type deposits exemplified in FIG. 1 due to their differing geologic characteristics distributed over great vertical heights. As shown in FIG. 2, the gas in tight sands deposits is contained in isolated, discontinuous sandstone stringers 58 of varying shapes and sizes which are in poor fluid communication with one another and are spaced over a vertical depth of typically more than about 500 feet and frequently over several thousand feet. Due to their highly heterogeneous nature, tight sands deposits include not one but a plurality of gas reservoir zones spaced over this large vertical depth interval. Due to the extreme thickness of tight sands deposits, the above-described conventional fracturing technique is of limited effectiveness in fracturing the numerous stringers 58 to permit the gas in the stringers to flow into the well 62. To fracture a multiplicity of such zones, the steps described above could be repeated for the larger stringers 58 and not the smaller stringers 58 due to cost prohibitions, thereby resulting in high well completion costs but also decreased oil and/or gas recoveries.

The fracturing technique described above is also not effective for fracturing zones located at greater depths than the bottom of the well. To employ the conventional fracturing technique, the well must be drilled to the depth of the target producing zone. This is often impractical and/or uneconomical for deep zones and/or for existing wells that for various reasons were originally drilled shallower than a desired target zone.

As a result of the high cost to drill and complete a well according to the above-noted technique, it is uneconomical to produce the oil and/or gas in many zones, especially zones located at depths below the bottom of the well or contained in the very thick tight sands deposits. Consequently, many oil and/or gas deposits are deemed uneconomic and therefore not recoverable.

SUMMARY OF THE INVENTION

An objective of the present invention is to provide an inexpensive method to produce fluids from subterranean zones. A related objective is to provide an inexpensive method for completing a well.

Another objective is to provide an inexpensive method for producing fluids from subterranean zones that are located below the total depth drilled in a well previously drilled or to be drilled.

Yet another objective is to provide an inexpensive method for producing fluids from tight sands deposits.

The present invention realizes one or more of the above objectives by providing a method for vertically extending a hydraulic fracture either upwards or downwards through a multiplicity of zones. The method includes the steps of introducing into the wellbore a first fracturing fluid to initiate a fracture in a zone and introducing a second fracturing fluid, having a different composition than the first fracturing fluid, to propagate the fracture in a substantially vertical direction. The direction of propagation of the fracture (i.e., upwards or downwards) is controlled by controlling the density (i.e., specific gravity) and thereby the static pressure gradient of the second fracturing fluid in the wellbore. In a first embodiment of the present invention, to propagate the fracture upwards the average pressure gradient is preferably less than about 65% of the average fracture extension pressure gradient of the zones to be fractured. Based on an average fracture extension pressure gradient of 0.88 psi/ft, the average fluid pressure gradient preferably ranges from about 0.25 to about 0.58 psi/ft. In a second embodiment, to propagate the fracture downwards the average pressure gradient preferably is more than about 120% of the average fracture extension pressure gradient of the zones to be fractured. Based on the average fracture extension pressure gradient of 0.88 psi/ft, the average fluid pressure gradient preferably ranges from about 1.10 to about 1.40 psi/ft.

To initiate a single unidirectional fracture, the initial fracture breakdown is achieved by a very slow injection of a relatively low density fluid. The initial fracture is then extended by a high viscosity fluid injected to a high volume rate to form a fracture having a size sufficient to accommodate a sufficient amount of the second fracturing fluid to cause the dominantly upward or downward fracture propagation. To yield this result, the initial fracture preferably has a vertical height of at least about 700 feet (i.e., about 350 feet radius from the point of injection).

The initial fracture extending fluid preferably has a high viscosity of at least about 500 Cp. The fluid's injection ratio should be as high as practical for the pumping equipment available.

To facilitate a dominantly vertical fracture growth, the second fracturing fluid (i.e., fracture pad) preferably has a relatively low viscosity and a relatively low injection rate. In the first embodiment, the second fracturing fluid has a preferred viscosity of no more than about 50 Cp and an injection rate of less than about 20 bbl/min. In the second embodiment, the second fracturing fluid has a preferred viscosity of no more than about 100 Cp.

To achieve vertically upward growth, this second fracturing fluid should have a specific gravity of less than about 1.0 and preferably less than about 0.5 to create dominantly vertical upward growth. To achieve vertically downward growth, the second fracturing fluid should have a specific gravity of no more than about 2.5 and preferably no more than about 3.0 to maximize vertically downward growth.

Additional fracturing fluids can be introduced to complete the well. For example, fracturing fluids containing various types and sizes of proppants can be introduced to prop the fracture open for later oil and/or gas production.

The completed fracture preferably has a ratio of its vertical component to its horizontal component of more than about 1.0, more preferably more than about 2.0 and most preferably ranging from 5 to 8. The vertical component preferably ranges from about 1,500 to about 10,000 feet.

The present invention addresses the limitations of existing well completion methods. The present invention can provide an inexpensive method to produce fluids from subterranean zones, particularly zones located at considerable depths, and thick and/or irregular zones, such as the typical tight sand deposits. The fracture of the present invention can extend vertically over thousands of feet in contrast to fractures yielded by existing fracturing techniques, which generally extend only over a few hundred feet or less.

The present invention can extend a downward growing fracture to penetrate and produce oil/gas from zones which are much deeper than the drilled total depth of the well. The substantially vertical fractures of the present invention thus permit the well to produce fluids from zones at much greater depths than the drilled depth of the well. The present invention can decrease drilling time for wells and thereby decrease the time and rate required to drill and complete such wells.

The tall slender (i.e., elongated) vertical fractures of the present invention enable existing completed wells to be easily and cheaply modified to produce fluids from subterranean zones that are deeper than the wells. The wells can be vertically extended without extensive and costly redrilling or deepening of the well. The present invention therefore can significantly increase the productivity of many existing wells.

In light of the unique capabilities of the present invention described above, the invention can significantly increase existing oil and/or gas reserves. It renders economic many oil and/or gas deposits that are presently uneconomic based on existing fracturing and/or other well completion techniques.

BRIEF DESCRIPTION OF THE DRAWINGS

FIG. 11 is a composite of FIGS. 9A–D and 10;

DETAILED DESCRIPTION

Figure 1:
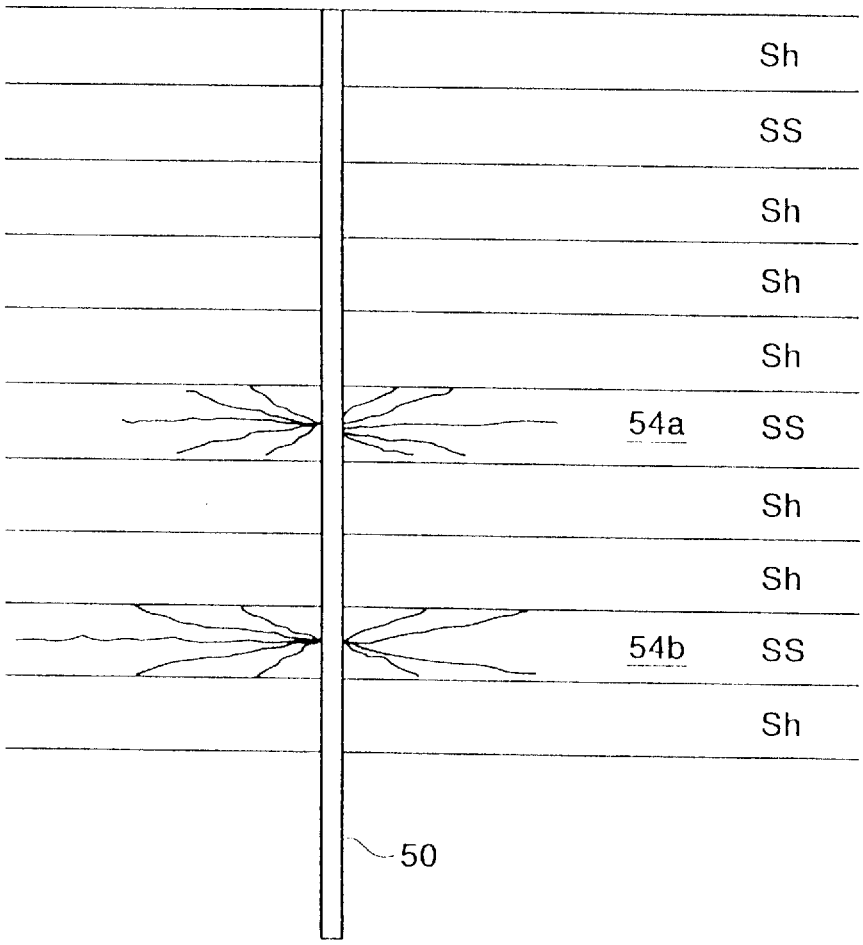
Fig. 1 PRIOR ART
FIG. 1 depicts a well completed according to existing fracturing techniques.
Figure 2:
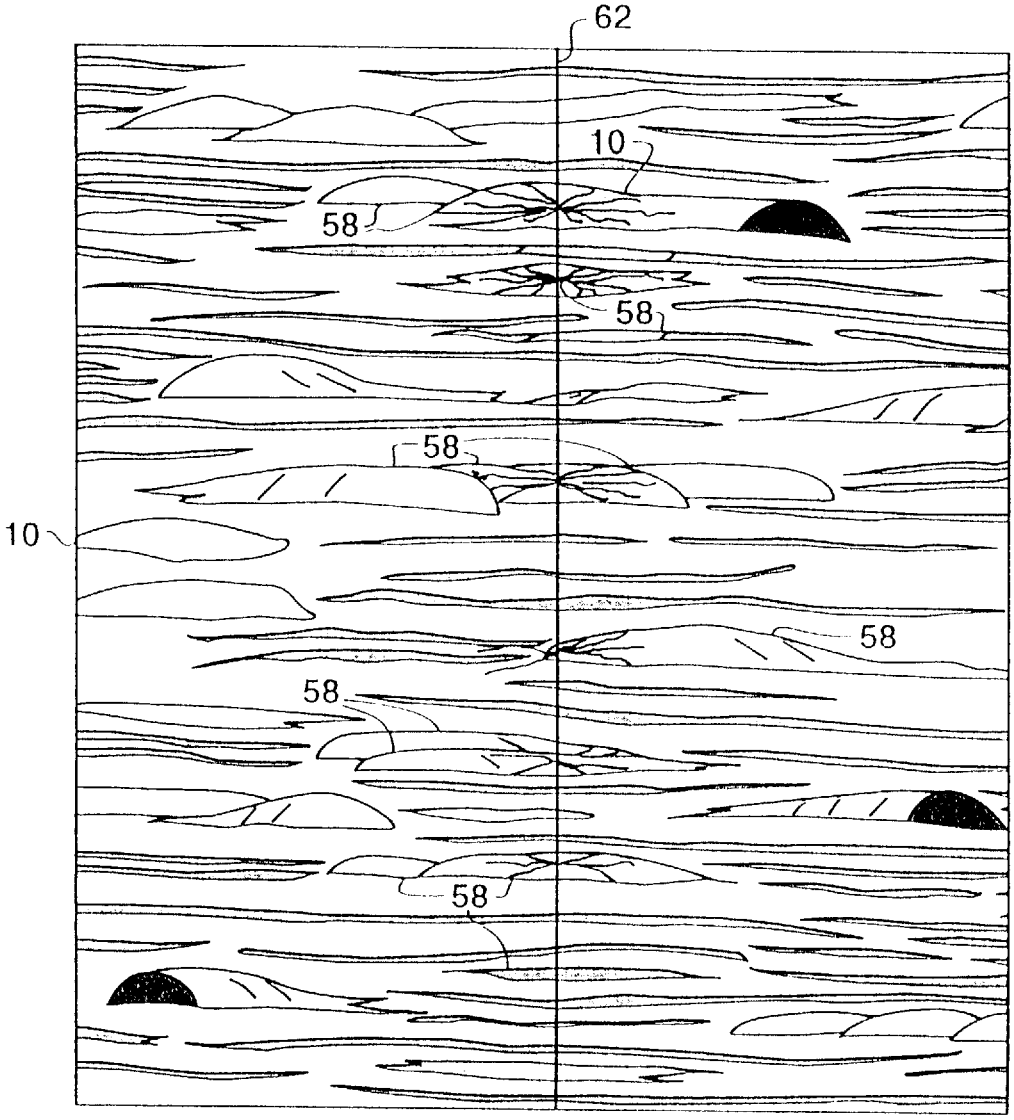
Fig. 2 PRIOR ART
FIG. 2 depicts another well completed according to existing fracturing techniques.
Figure 3:
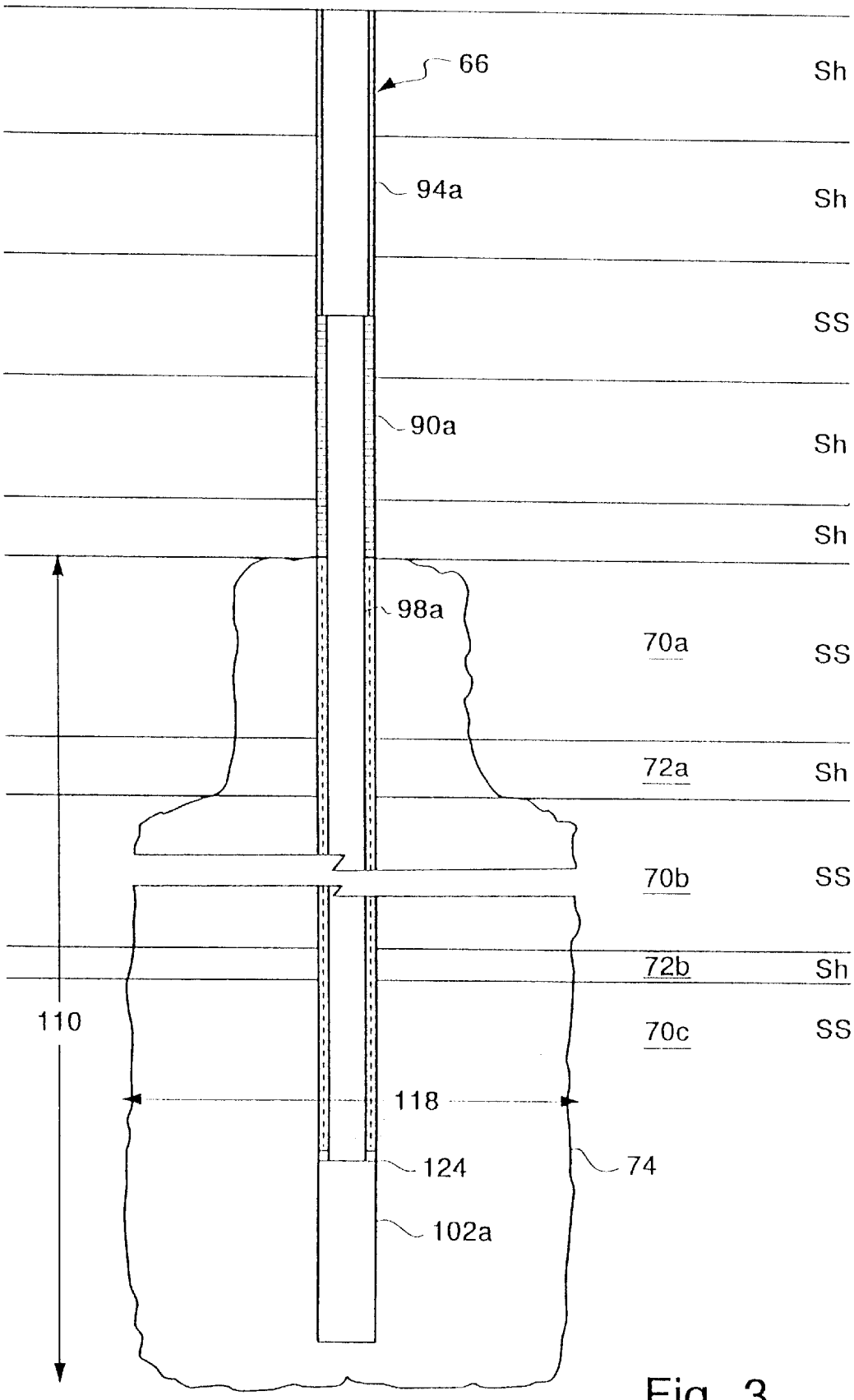
FIG. 3 depicts a well completed according to a first embodiment of the present invention.
Figure 4:
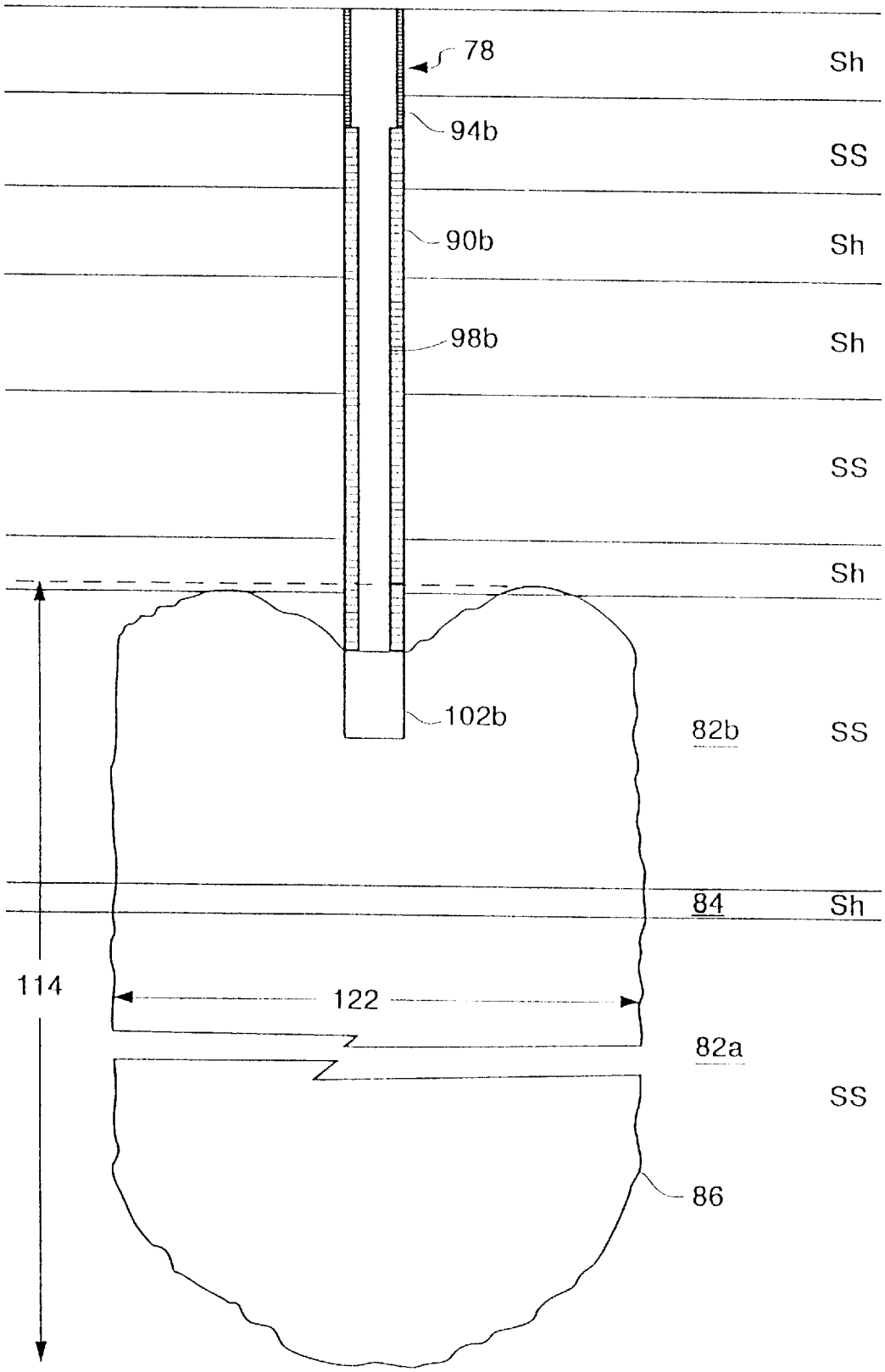
FIG. 4 depicts a well completed according to a second embodiment of the present invention.

The present invention is based on the recognition that a more efficient system for recovering fluids from deep zones and/or tight sands deposits is to employ substantially vertical fractures of relatively tall vertical heights and shorter horizontal lengths emanating from an open segment of a wellbore. Two embodiments of such a system are depicted in FIGS. 3 and 4. In the first embodiment of FIG. 3, the wellbore 66 extends through the zone(s) 70*a,b,c* of interest and intermediate zones 72 *a,b* with a fracture 74 extending vertically upward through the various zone(s). In the second embodiment of FIG. 3, the wellbore 78 has a depth less than the depth of a zones(s) 82*a* of interest with a fracture 86 extending vertically downward through the various zone(s) 82*a, b*, 84. In both vertical figures, the planes of the fracture 74, 86 are in the plane of the page. Unlike existing fracturing techniques, both embodiments described herein have a single fracture extending vertically through a plurality of zones.

In both embodiments, the well 10 includes the wellbore 90*a,b*, a well casing 94*a,b*, a well head (not shown), and a production casing 98*a,b* positioned within the well casing 94*a,b*. The wellbore 90*a,b* generally has a diameter ranging from about 7 to about 15 inches. The well casing 94*a,b* generally has a diameter ranging from about 4 to about 10 inches. The well casing 94*a,b* is preferably cemented to the wall of the wellbore 90*a,b*. The well head (not shown) is supported by the well casing 94*a,b*. The production casing 98*a,b* is attached to the well head.

The cemented portion of the well casing should extend below the depth of any exposed water-producing sediments to seal such sediments from the open wellbore 90*a,b*.

The open wellbore 102*a,b* is located below and in communication with the lower portion of the production casing 98*a,b*. As discussed below, the hydraulic pressure on the sediments 70*c*, 82*b* from the fracturing fluid in the open wellbore 102*a,b* causes the formation of the fracture 74, 86 from the open wellbore 102*a,b*. The fracturing fluid can be any compressible or non-compressible fluid used to initiate and propagate hydraulic fractures through the rocks or sediments.

The fractures 74, 86 extend from the open wellbore 102*a,b* through various intermediate non-productive sediment zones 72*a,b* and 84 to and through one or more desirable zones 70, 82. Valuable fluids, such as water, oil and/or gas, travel along the fractures 74, 82 into the well 66, 78 for collection. In the first embodiment of FIG. 3, the fracture 74 generally has a vertical height (i.e., vertical component) ranging from about 1,500 to about 5,000 ft, a horizontal length (i.e., horizontal component) ranging from about 500 to about 1,500 ft, and a width at the wellbore ranging from about 0.10 to about 0.50 inches. In the second embodiment of FIG. 4, the fracture 82 generally has a vertical length ranging from about 2,500 to about 10,000 ft, a horizontal length ranging from about 500 to about 2,000 ft, and a width at the wellbore ranging from about 0.10 to about 0.50 inches. As will be appreciated, the use of the fracture 82 in the second embodiment to extend the well 78 to the deeper zone 82*a* permits a shallower well to be drilled to access the zone 82*a* than is allowable with existing methods.

Figure 5:
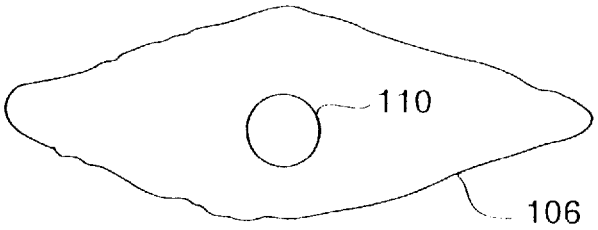
FIG. 5 is a plan view of a fracture completed according to either embodiment of the present invention.

Referring to FIG. 5, a plan view of the wellbore and fracture pattern 106 is depicted for both embodiments. The vertical fracture (plan view) pattern 106 is typically about 0.2 to about 0.5 inches wide at the wellbore 110 and tapers down to about "0" inches in width at the fracture tip. As will be appreciated, the precise fracture pattern can vary depending upon the characteristics of the rocks to be fractured.

Returning to FIGS. 3 and 4, for optimal results, it is important to maximize the vertical components 110, 114 of the fractures 74, 86 (or rate of growth (i.e., increase) in the vertical direction during fracturing) while minimizing the horizontal components 118, 122 (or rate of growth in the horizontal direction during fracturing). The ratio of the vertical component (or rate of growth (i.e., increase) in the vertical direction during fracturing) to the horizontal component (or rate of growth in the horizontal direction during fracturing) is preferably more than about 2.0 and more preferably ranges from about 4.0 to about 7.0.

As will be appreciated, the direction and shape of the fractures 74, 86 can be influenced by (i) variations in the fracture extension pressure gradients of the various sediments to be fractured, (ii) fracturing fluid friction pressure losses, and (iii) density (i.e., specific gravity) of the fracturing fluids. The difference between the average fracture extension pressure gradient of the zone(s)/sediments to be fractured and the average pressure gradient of the fracturing fluid in the fracture can be used to control the ratio of vertical to horizontal growth and thereby the geometry of the vertical fracture. The greater the difference between them equates to a greater vertical to horizontal growth ratio. When the average fracture extension pressure gradient of the rock exceeds the average static fracture fluid pressure gradient, the fracture will propagate (i.e., grow) upwards. When the average fracture extension pressure gradient is less than the average static fracture fluid pressure gradient, the fracture will propagate (i.e., grow) downwards.

To form a vertical fracture propagating upwards in the first embodiment, the average static pressure gradient of the fracture propagation fluid preferably is no more than about 65%, and preferably less than about 40%, of the average rock fracture extension pressure gradient of the zone(s) to be fractured. Based on an average rock fracture extension pressure gradient of 0.88 psi/ft, the average static fracture propagating fluid pressure gradient preferably is no more than about 0.60 psi/ft and more preferably ranges from about 0.45 down to about 0.20 psi/ft or less.

To form a vertical fracture propagating downwards in the second embodiment, the average static pressure gradient of the fracture propagation fluid preferably is more than about 120%, and more preferably over about 140%, of the average fracture extension pressure gradient of the zone(s) to be fractured. Based on an average fracture extension pressure gradient of 0.88 psi/ft, the average pressure gradient preferably is more than about 1.05 psi/ft and more preferably ranges from about 1.20 to about 1.40 psi/ft.

The fluid friction loss along the fracture also influences the geometric shape of the fracture. Higher friction loses resulting from high viscosities and high injection rates (i.e., about 65 bbl/min. or higher), cause the fracture to propagate upward, outward and downward in a more symmetrical radial pattern resulting in a penny-shaped fracture. The friction loss increases with fracturing fluid viscosity and volumetric injection rate.

Referring to FIG. 3, the process used to form the fracture 74 of the first embodiment will now be described. Before fracturing can be initiated, the well head casing 94*a*, well head (not shown), and production casing 98*a* are installed in the wellbore 90*a*. The production casing is positioned in the wellbore to yield the open wellbore 102*a* below the production casing 98*a*.

To prepare the well 66 for the fracturing fluid (not shown), a cleaning fluid (not shown) can be correlated in the open wellbore 102*a*. The cleaning fluid scours the walls of the wellbore 102*a* and displaces and removes mud in the wellbore 102*a*.

Figures 6A, 6B, 6C, 6D, 6E:
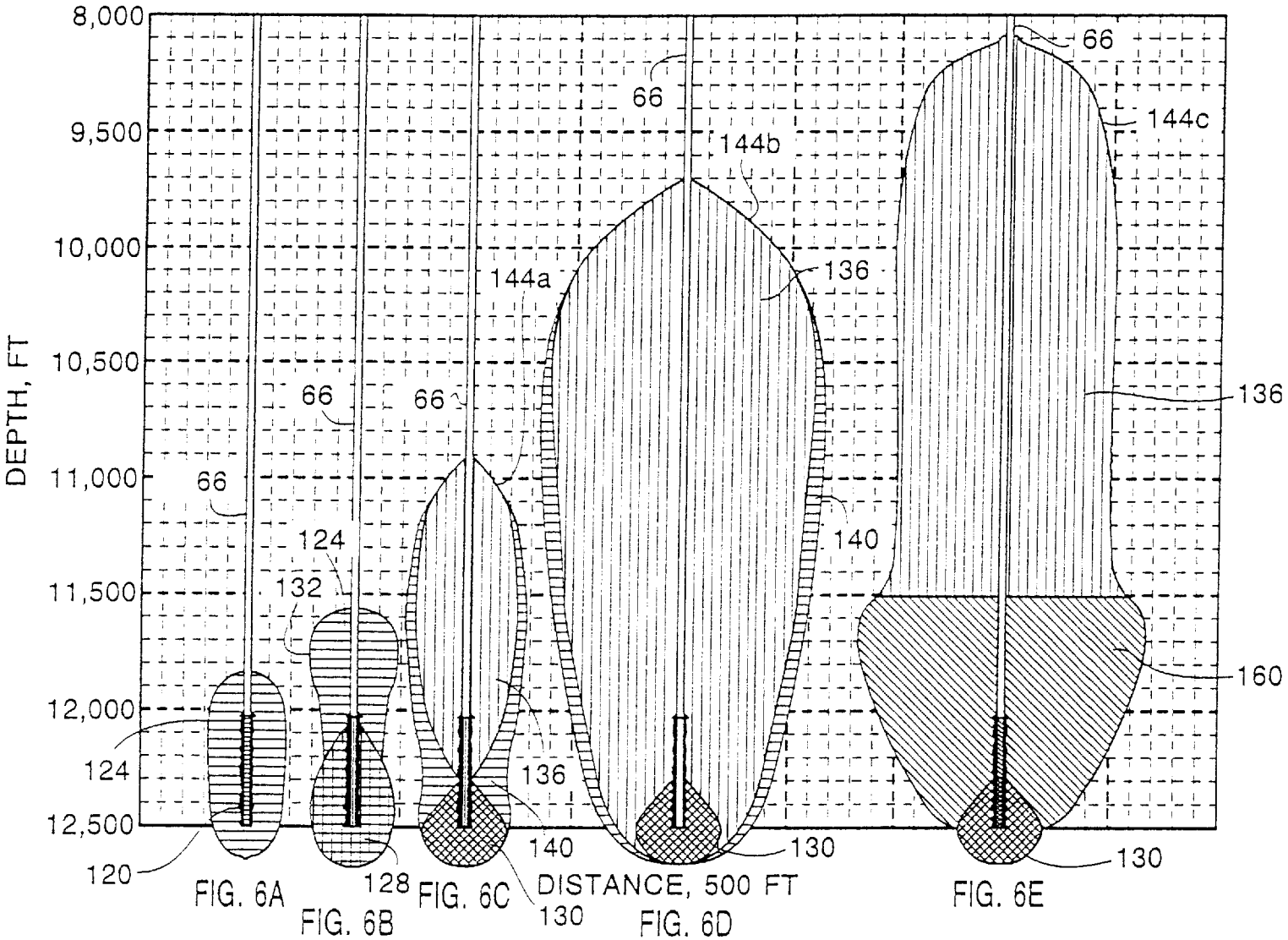
FIGS. 6A–E depict the propagation of a fracture according to the first embodiment for vertically upward fracture growth.

Referring to FIG. 6A, after well preparation, the first fracturing fluid, a fracture initiation fluid 120, is introduced into the open wellbore 102*a* through the production casing 98*a* to form a fracture in the zone 70*c*. The fracture will typically propagate in a plane that is substantially perpendicular to the zone's axis of least principal stress (i.e., horizontally). The fracture initiation fluid 120 will move to the bottom of the wellbore 90*a* and fill the open wellbore 102*a*, displacing the cleaning fluid and causing the fracture 74 to form from the top 124 of the open wellbore 102*a*. At the top of the open wellbore, the exposed portion of zone 70*c* is shallowest and therefore has the least principal stress breakdown pressure for fracture initiation. While not wishing to be bound by any theory, it is believed that as the fracture length increases, the fracture initiation fluid will have increased friction loss (causing increased friction pressure) along the length of the fracture, causing the fracture to propagate vertically by extending itself into the adjacent zones with slightly higher fracture extension pressures.

After fracture initiation, the fracture initiation fluid 120 preferably has a relatively high viscosity and preferably is injected at as high a rate as practical to create a relatively high friction loss to propagate or extend the fracture. The fracture initiation fluid is preferably gelled water having an average viscosity of no less than about 305 Cp, more preferably greater than about 500 Cp, and even at least about 1,000 Cp is desirable in some cases. The gelled water fracture initiation fluid is substantially free of a proppant.

To facilitate vertical fracture growth into shallower zones, the preferred average pressure gradient of the fracture initiation fluid in the wellbore is as noted above. This pressure gradient will cause the fracture to grow upward rather than downward.

The resulting fracture 124 has sufficient horizontal and vertical lengths and widths to accommodate later fracturing fluids for vertical growth of the fracture. A vertical fracture height of at least about 500 feet, and more preferably ranging from about 800 to about 1,200 feet, is preferred to initiate the desired vertical fracture growth. The acceleration in the growth rate of the vertical fracture component 110 increases as the total vertical length 110 of the fracture increases. The maximized growth rate in the vertical fracture component 110 is realized when the vertical fracture height is more than about 2,000 feet.

Referring to FIG. 6B, following the formation of the fracture 124 a proppant-carrying fracture (i.e., wellbore packing) fluid 128 can be introduced into the wellbore 102*a* to displace the lighter fracture initiation fluid 124 upwards and fill the lower portion of the fracture 132 with proppant. The lower portion of the fracture will thereby be propped open. The displaced fracture initiation fluid 124 will continue propagating the fracture 132 vertically upwards.

The wellbore packing fluid 128 is a proppant-containing slurry. This proppant/liquid slurry preferably ranges from about 65 to about 75% by volume liquid and about 25 to about 35% high strength, high density proppant. This yields a fluid specific gravity preferably ranging from about 2.75 to about 3.18. The static fluid pressure gradient of this slurry preferably ranges from about 1.19 to about 1.38 psi/ft.

The proppant in the slurry preferably has a specific gravity of more than about 7.0. The preferred proppant is steel shot (7.5 specific gravity) having a size ranging from about 10 to about 16 mesh (Tyler).

The gelling agent of the wellbore packing fluid 128 is caused to break and release the proppant preferably within about 10 to about 20 minutes after introduction into the fracture where its temperature rapidly increases up to the normal formation temperature. This increase in temperature activates a gel-breaking agent contained in the gelled slurry. The proppant then settles out of the slurry and settles to the bottom of the fracture 130.

Referring to FIGS. 6C–D, to propagate the fracture upward to yield the desired vertical component 110 while substantially minimizing the horizontal component 118, a low density fracture propagation fluid 136 is next introduced into the wellbore 102*a*. This low density fracture propagation fluid 136 may be a low viscosity nitrogen foam, or a low viscosity ungelled water.

The static fluid pressure gradient of this vertical growth fracture propagation fluid should be less than about 0.50 psi/ft and preferably ranges from about 0.20 to about 0.45 psi/ft. Consequently, the specific gravity of the fracture propagation fluid should be less than about 1.15 and more preferably ranges from about 0.46 to about 1.04. The difference between the typical rock fracture extension pressure gradient and the static fluid pressure gradient should be greater than 0.40 psi/ft and preferably ranges from about 0.43 to about 0.68 psi/ft or more. This difference yields a very large upward driving force pushing a spearhead of the fracture propagation fluid in the fracture 144 more strongly vertically rather than horizontally. The fracture propagation fluid 136 preferably has a low viscosity and is introduced at a relatively low rate to maximize the ratio of vertical fracture height to horizontal length by substantially minimizing friction pressure along the fracture. The preferred viscosity is less than about 10 Cp and more preferably ranging from about 1 to about 3 Cp. Preferably, the fracture propagation fluid rate is less than about 20 bbl/min.

To further maximize the fracture height produced by the fracture propagation fluid 136, the fluid can include a fluid loss inhibitor. The fluid loss inhibitor prevents the loss of fluid through microfractures and fissures in the sediments through which the fracture propagates. A preferred fluid loss inhibitor may be benzoic acid crystals which yields a filter cake barrier over all of the permeable zones. Later gas production from the zones will vaporize the benzoic acid, thereby eliminating the filter cake barrier. Alternatively, other gas vaporizable crystals or flakes can be used for this purpose.

Referring to FIG. 6E, a high viscosity fracture transition fluid 160 can be introduced into the well 66 to increase the width of the fracture 144 to prevent screen-out of proppant-containing fracturing fluids in later stages. As will be appreciated, screen-out can occur at fluid interfaces. The fluid preferably increases the width of the fracture at the wellbore to more than about 0.25 inches and more preferably more than about 0.40 inches. The width increase is caused by the high friction pressure along the fracture from the high viscosity of the fluid. The fracture transition fluid displaces the lighter fracture propagation and fracture initiation fluids and the liquid component of the wellbore packing fluid upwards, thereby causing additional vertical fracture growth.

The fracture transition fluid 160 preferably has a viscosity of no less than about 350 Cp and more preferably ranging from about 500 Cp to about 1,000 Cp or higher. The preferred fracture transition fluid is a gelled water. The gelling agent in the fracture transition fluid can be any suitable gelling agent.

As will be appreciated, the width of the fracture depends upon the viscosity and the injection rate of the fracture transition fluid. Preferably, the injection pumping rate is more than about 35 bbl/min, more preferably more than about 50 bbl/min, and most preferably more than about 60 bbl/min.

When the transition fracture 160 (FIG. 6E) has the desired horizontal length component, the propagation of the horizontal component 118 (FIG. 3) can be arrested by introducing a moderate to low concentration of fracture proppant into the fracture transition fluid. This proppant will create a fracture-tip screen-out as the fracture attempts to propagate further in the horizontal direction and the proppant gets wedged into the very narrow fracture tip. Accordingly, the magnitude of the horizontal component 118 (FIG. 3) of the fracture depends upon when the proppant is added to the fracture transition fluid.

The proppant will not, however, screen-out the vertical growth of the fracture. As the fracture transition fluid flows upward through the fracture, the fracture is too wide (i.e., 0.25 to 0.40 inches) for screen-out to occur. Thus, the fracture transition fluid will continue to propagate the vertical component 110 (FIG. 3) of the fracture.

Any standard fracture proppant may be used to induce this horizontal fracture tip screen to stop horizontal fracture growth. The proppant size preferably ranges from about 16 to about 30 mesh (Tyler). The concentration of the proppant in the tip-screen-off portion of the fracture transition fluid (i.e., slurry) may start at about 10% and gradually increase to about 40% by volume.

If the fracture transition fluids were to be introduced without the previous introduction of the fracture initiation and fracture propagation fluids in the manner described herein, a traditional, penny-shaped fracture would result. Such a fracture would not realize the cost and production benefits of the present invention.

Figures 7A, 7B, 7C:
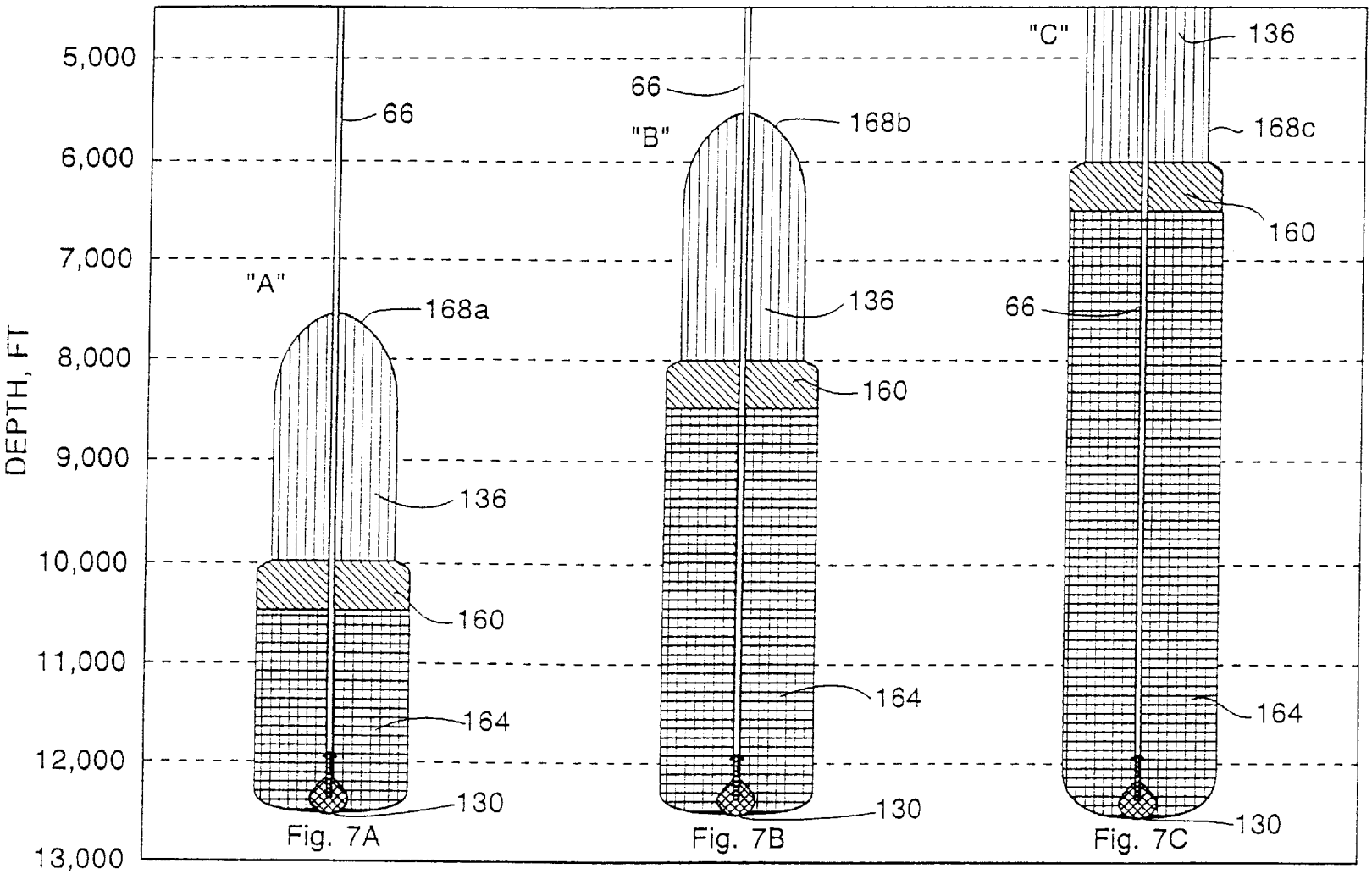
FIGS. 7A–C depict the propagation of the fracture in the first embodiment during introduction of the proppant-carrying fracture (i.e., fracture packing fluid)

Referring to FIGS. 7A–C, a proppant-carrying fracture slurry (i.e., fracture packing fluid) 164 can be introduced into the well 66 to carry proppant into the fracture while continuing to grow the fracture in the vertically upward direction. The proppant-carrying fracture slurry 164 preferably ranges from about 55 to about 70% by volume liquid and about 30 to about 45% by volume proppant.

The fracture packing fluid (i.e., proppant-carrying fracture slurry) 164 uses any of the available proppants and gelling agents capable of carrying the proppant concentration.

In the event the filter cake barrier formed by the fluid loss inhibitor in the prior injected fracture fluids breaks down or is displaced as the fracture grows, the fracture packing fluid will quickly reseal, replace or reinforce the filter cake barrier to prevent or minimize any further fluid losses.

The upper limit on the vertical growth of the fracture is determined by the time selected for breaking the gelling agent in the fracture packing fluid to cause the proppant to settle out of the slurry. When the gelling agent is broken, the proppant will fall, the vertical and the fracture growth will be arrested.

Figures 8A, 8B, 8C:
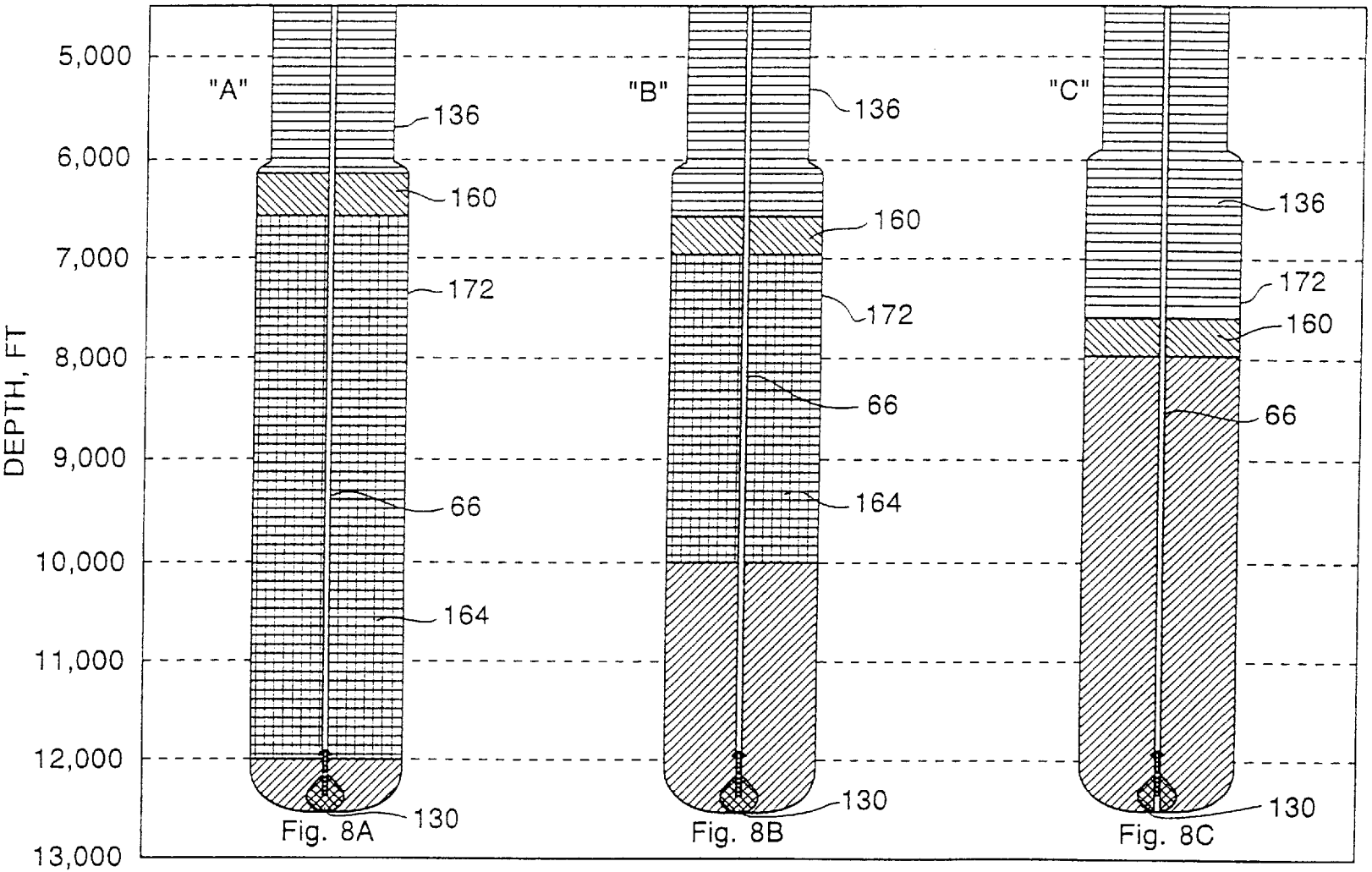
FIGS. 8A–C depict the gel breaking process in the first embodiment.

Referring to FIGS. 8A–C, the gelling agent is preferably broken in time sequence upward from the bottom to the top of the fracture 172 over a designated period of time. In this manner, the proppant will settle out of the fracture packing fluid substantially uniformly along the length of the fracture 172. If the gel breaking agent were to be broken in time sequence downward from the top of the fracture or simultaneously throughout the fracture packing fluid, then portions of the fracture would close before proppant could be placed in the fracture portions, thereby adversely impacting the ability of oil and/or gas to flow vertically along the fracture.

The gel breaking agents in the fracture transition and fracture packing fluids therefore should take into account the temperature gradient over the total vertical component of the fracture 172 and the cooling of the sediments by the volume of the various fluids displaced past the sediments during the above-described steps and the time period over which the gelling agents are to be broken. As soon as enough of the proppant-carrying fracture slurry (i.e., fracture packing fluid) is broken at the bottom of the fracture to drop enough proppant to cover the open hole portion of the wellbore, then, the well operator should start flowing (or swabbing) the wellbore to cause the unbroken gelled proppant-carrying fracture slurry to flow downward and through the proppant sand pack to filter out the proppant sand from the partially broken gel water (even before the gel is fully broken). This building of a proppant pack by downward flow of the slurry through the sand pack will grow a wider fracture sand pack than would the uniform breaking of a gelling agent.

The various fracturing fluids described above can include a salt to control the oleophilic or hydrophilic character of the sediments and to reduce the hydration and swelling of clay in the well 66 and cause the attachment of the clay to the walls of the well 66. As will be appreciated, hydration and mobility of the clay can cause plugging and premature sanding off of portions of the fracture. While not wishing to be bound by any theory, it is believed that the cations in the salt will enter the space between clay mineral plates and replace the sodium cations by ion exchange, thereby causing dehydration and shrinkage of the clay and possible change of surface wettability.

Depending upon whether the sediments initially have an oleophilic or hydrophilic character, the fracture water salt solution includes either a dominant mono-valent cation or a dominant multi-valent cation. For hydrophilic sediments, the preferred cation is potassium. For oleophilic sediments, the preferred cations are calcium and/or magnesium, with divalent calcium being most preferred. Such divalent cations will induce clay mineral shrinkage and preserve the oleophilic nature of the sediments. In the case of oleophilic sediments, it is desired that the fracture fluid be substantially free of mono-valent cations to avoid changing the mineral-surface wettability of the sediments from their natural oleophilic nature to an artificially-induced hydrophilic nature. Such a fluid appears to reduce the thickness of the expandable-clay-mineral, adsorbed water layers, and thereby shrinks the clay mineral assemblages.

The calcium chloride salt in a high pH (over 10 pH) water solution appears to cement the clay minerals to the other silicate minerals in the sediments. A "Topermorite"-like cementing material is formed by creating a hydrated calcium silicate with the dissolution of a surface layer on the clay minerals and other silicate surfaces. Such cementation of the clay minerals to the other silicate surfaces prevents the clay minerals and other ultra fine grained minerals from migrating and plugging the pore space constrictions during production.

The preferred salt is calcium chloride in a concentration ranging from 0.5% to 2.0% with a pH ranging from about pH 9.5 to about pH 10.5 or pH 11.0.

In the second embodiment, the fracture is propagated downward rather than upward. The processes used to yield the two different embodiments are different in a number of respects. A key distinction is the use of significantly heavier spearhead fracturing fluids in the second embodiment to cause downward as opposed to upward growth of the fracture. These differences are discussed in detail below.

Referring again to FIG. 4, the well 78 should be drilled to a depth that is within the envelope of gas saturated reservoir 82*a* that do not contain significant water producing zones 82*a*.

Figure 9A:
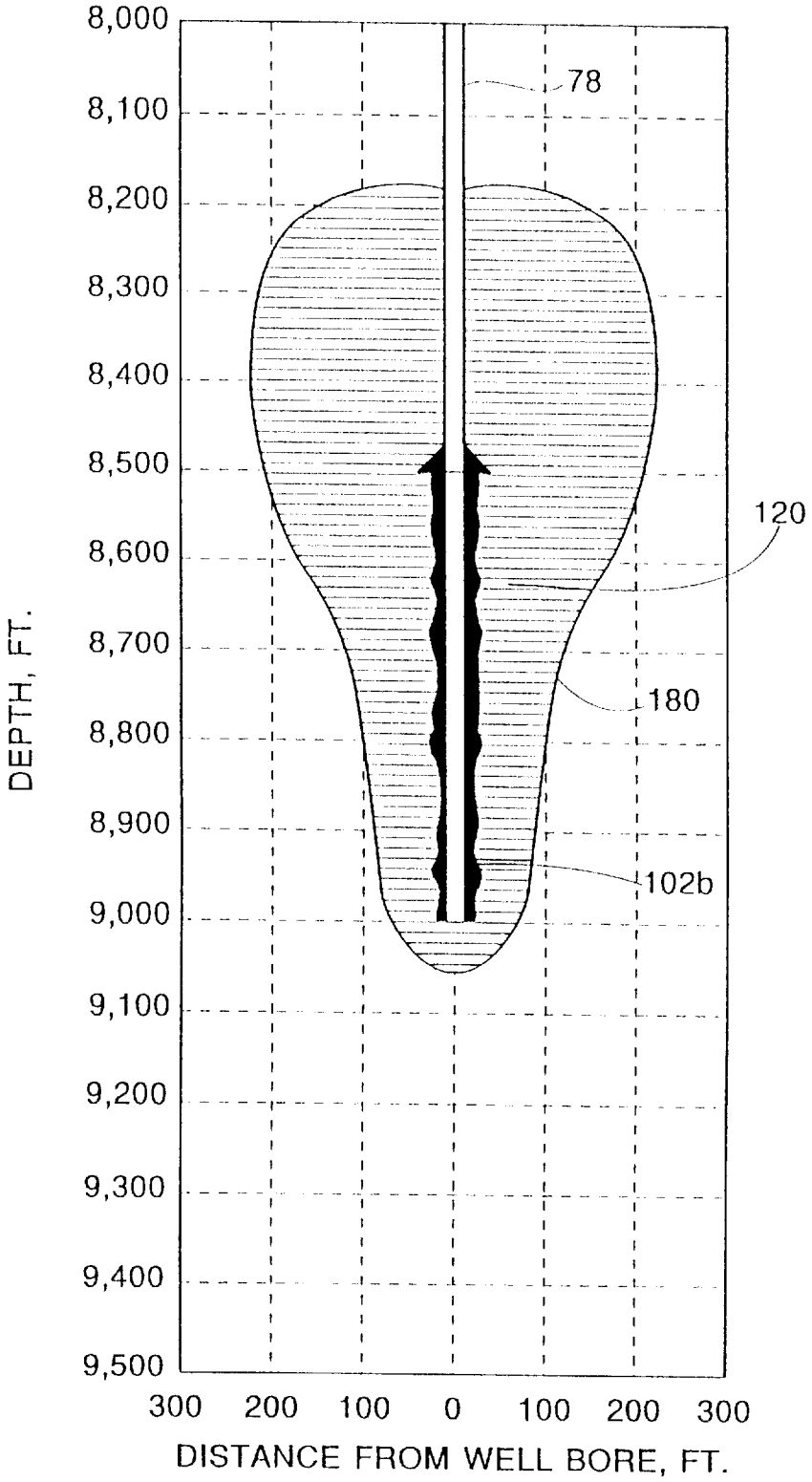
FIGS. 9A–D depict the propagation of the fracture in the second embodiment for vertically downward fracture growth.

Referring to FIG. 9A, after formation of the open wellbore 102*b*, as discussed above, the fracture initiation fluid 120 is used to form the fracture 180 as described above. The rate of injection of the fracture initiation fluid 120 is preferably gradually increased over time from a low to a high injection rate.

Figure 9B:
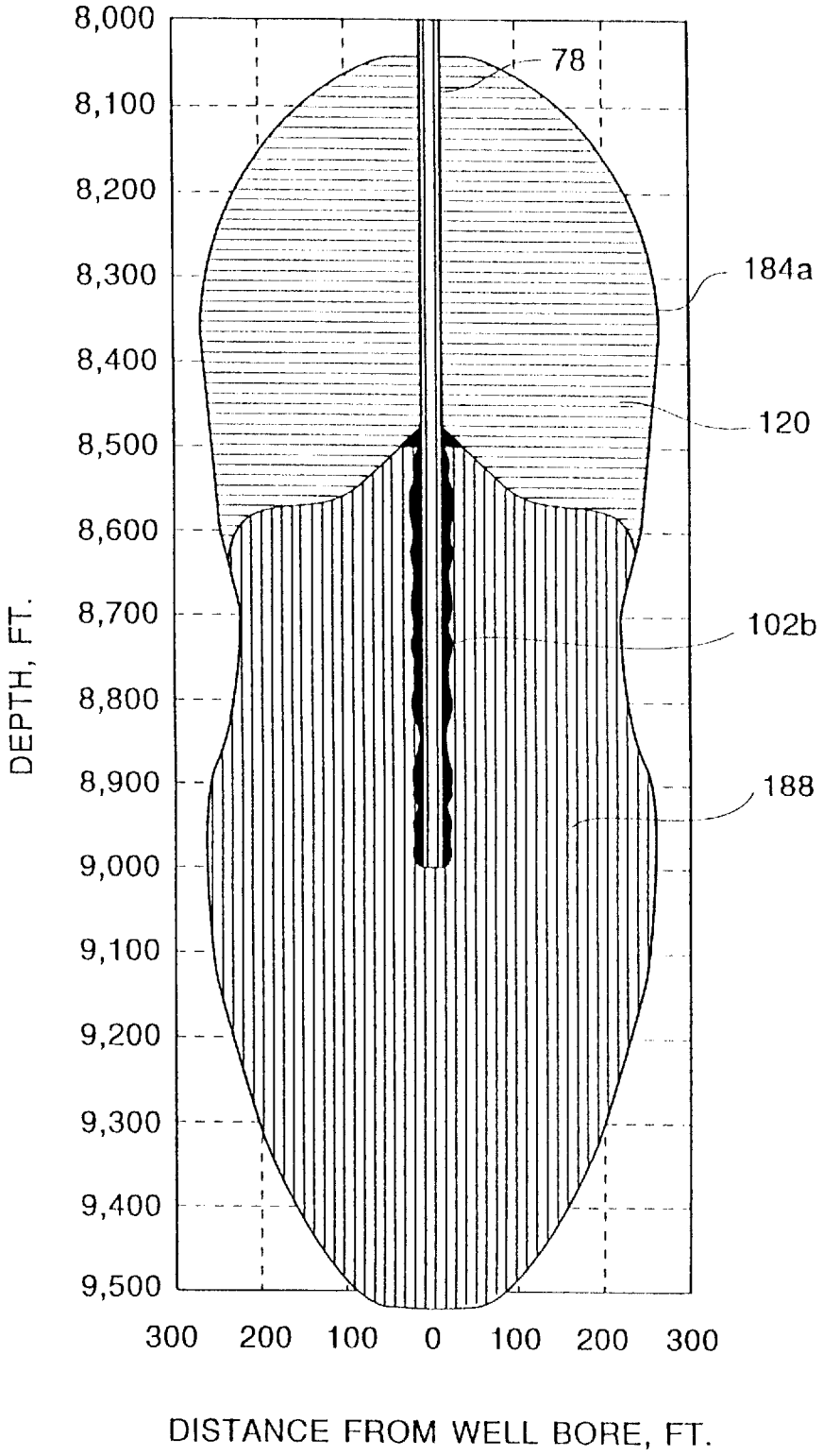
Figure 9C:
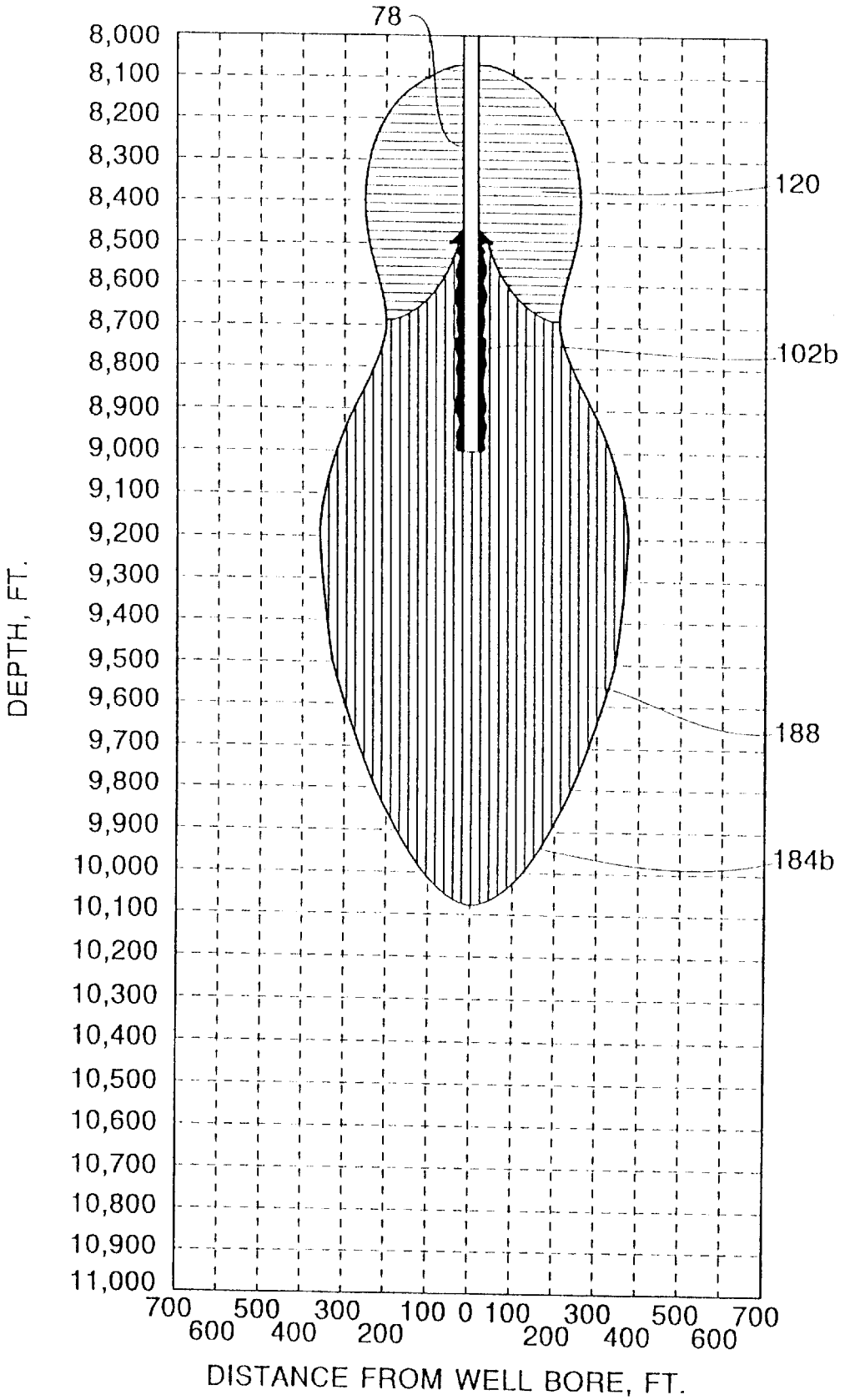
Figure 9D:
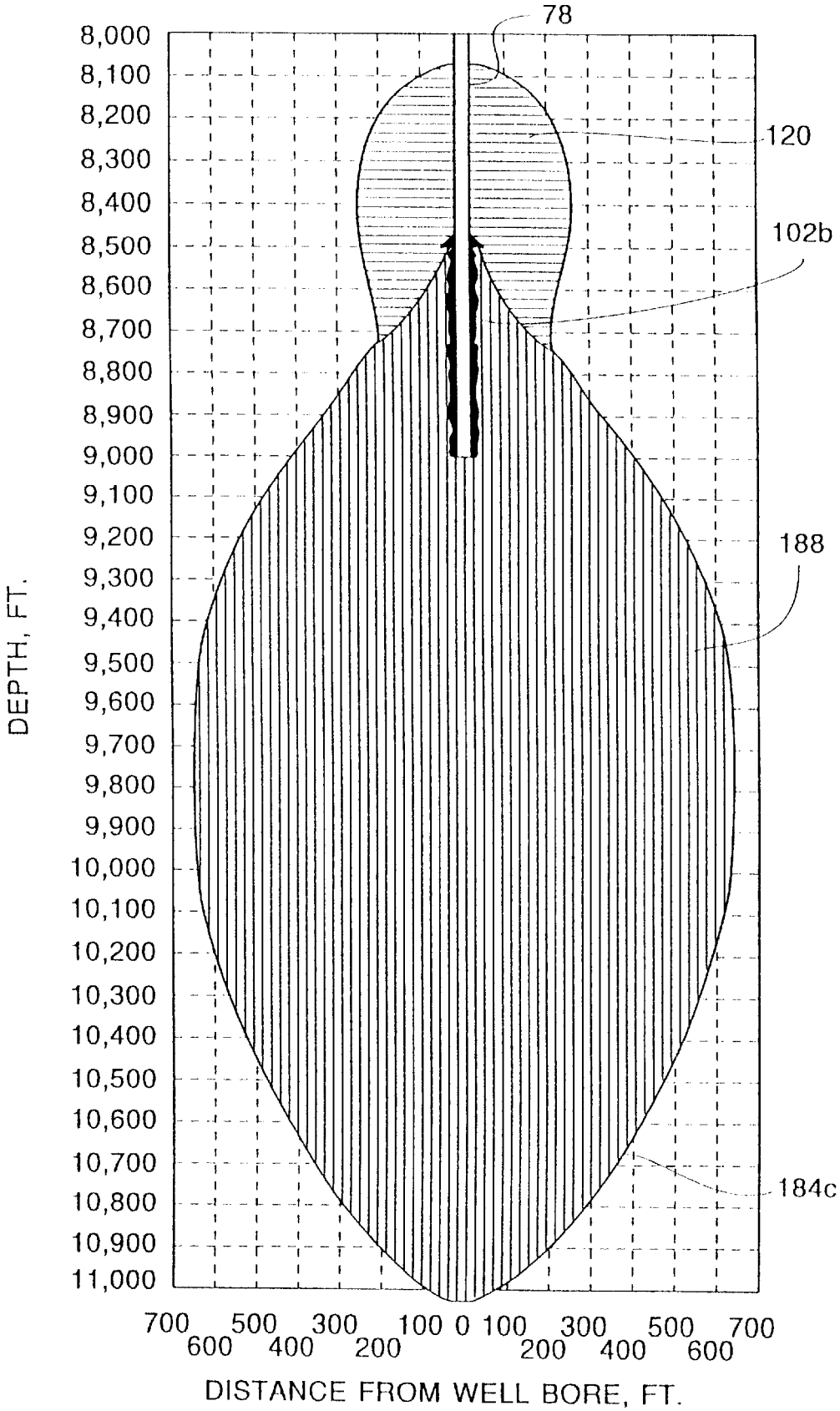

Referring to FIGS. 9B–D, a high density fracture propagation fluid 188 is next introduced into the well 78 to extend the fracture. The high density fracture propagation fluid 188 displaces the lighter fracture initiation fluid upwards and propagates the fracture 184 upwards and downwards. FIGS. 9B–D illustrate the propagation of the fracture 184*a–c* at various stages during introduction of the high density fluid.

The fracture propagation fluid 188 in the second embodiment significantly differs from the fracture propagation fluid 136 in the first embodiment. Unlike the fracture propagation fluid 136, the fracture propagation fluid 188 contains preferably an ultra fine mesh (i.e., less than about 325 mesh (Tyler)) heavy proppant, typically a mineral powder, to create a high density slurry. The proppant content of the fracture propagation fluid preferably ranges from about 40 to about 45% by volume.

The preferred proppant has a specific gravity of no less than about 4.5 and more preferably about 5.0. To further increase the density, one can use a mixture of about 40% of 325 heavy mineral powder plus about 3% of iron (steel)

shot/grit ballast with a specific gravity of about 7.5 in a size ranging from about 50 to about 150 mesh (Tyler).

The heavy mineral proppant also serves as a fluid loss preventative. Without such a preventative, the fluid in the various fracturing fluids may flow into pores or cracks in the rock and thereby decrease the fluid content of the slurry. Such fluid loss may cause the residual slurry to plug the hydraulic fracture and terminate fracture growth.

The proppant causes the fracture propagation fluid to have a relatively high specific gravity and static pressure gradient in the fracture. The specific gravity preferably is more than about 2.5 and more preferably ranges from about 2.75 to about 2.90. The resulting static fluid pressure gradient in the fracture ranges from about 1.19 to about 1.25 psi/ft (minimum of about 1.08 psi/ft). The difference between the typical fracture extension pressure gradient and the fluid pressure gradient ranges from about 0.3 psi/ft to about 0.38 psi/ft or more. This difference yields a very large downward driving force pushing a spearhead of the fluid 188 more strongly vertically downward rather than horizontally outward.

The fracture propagation fluid 188 preferably has a relatively low viscosity to reduce the friction pressure. The viscosity is preferably no more than about 100 Cp and preferably less than about 50 Cp. By combining the low viscosity with a slow pumping rate of about 20 bbl/min or less, the fluid friction loss along the fracture growth path is low enough for the density forces to dominate the fracture growth pattern.

The fracture propagation fluid 188 can be prepared by initially forming a moderately high density slurry using the heavy mineral proppant and then combining the slurry with the cast iron (steel) shot/grit ballast. The slurry is formed by dispersing the heavy mineral powder in a low viscosity polymer-dispersant-solution. The solids content of the slurry preferably ranges from about 35 to about 45% by volume.

Because of the difference in sizes between the two solids dispersed in the slurry, this slurry has a substantially lower viscosity and reduced risk of accidental screen-off than a slurry of equal percentage total solid content with all of the solid particles having a nearly uniform particle size.

The fracture propagation fluid 188 is preferably injected at low rates (i.e., about 10 bbl/min and lower) in the initial stages and higher ratio (i.e., 30 bbl/min and higher) in later stages. In this manner, the introduction of the fracture propagation fluid is able to keep pace with the increasing rate of fracture propagation.

The fracture propagation fluid 188 can be introduced during fracturing either continuously or discontinuously. The discontinuous addition of the fracturing fluid 188 results in "slugs" of the fracturing fluid moving down the open wellbore 102*b*.

Figure 10:
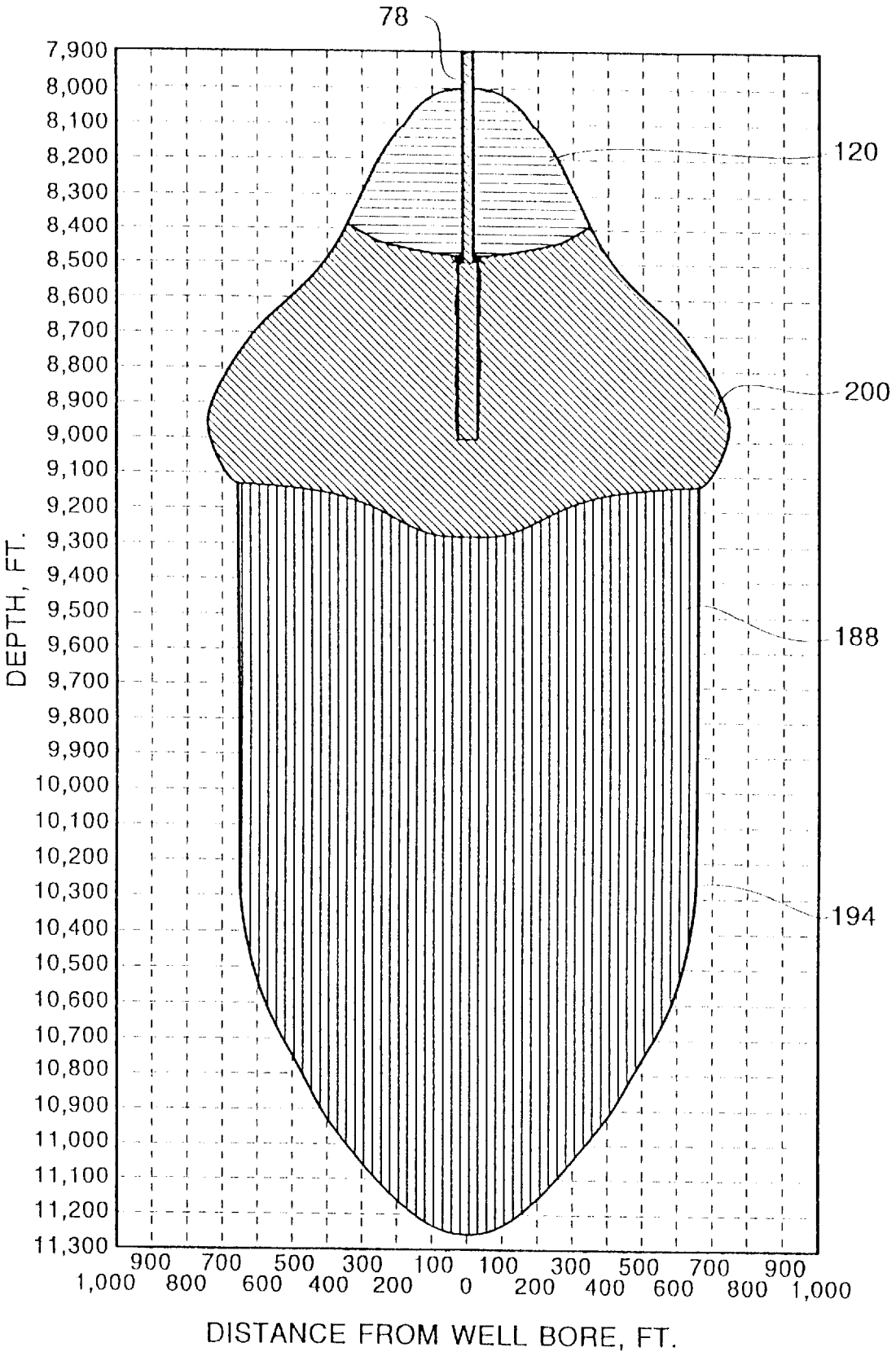
FIG. 10 is a plot of the fracture depth against pressure in the second embodiment.

Referring to FIG. 10, a high viscosity, high gel strength fracture transition fluid 200 can be introduced to increase the fracture width from about 0.15 inch up to about 0.3 to 0.4 inch or more at the wellbore prior to introduction of any normal fracture proppant. The proppant content of the fracture transition fluid is gradually increased from about 10% to about 30% by volume. When the fracture horizontal length of the transition zone has reached its desired length, then the proppant is added to the high viscosity transition fracture fluid to cause a fracture-tip-screen-out thereby stopping the fracture horizontal growth.

The viscosity is preferably at least about 350 Cp and more preferably about 300 to about 1000 Cp. The relatively high viscosity provides a high friction pressure along the fracture which greatly increases the fracture width.

The coarse proppant particles in the transition zone slurry will cause screen-out to occur as the fracture propagates horizontally but not vertically. As the very narrow, wedge-shaped, fracture tip propagates horizontally, the fracture transition fluid 200 will surge or spurt into the newly created void. The coarse proppant particles will be caught between the opposing walls of the fracture causing screen-out to occur at the horizontal fracture tip. As the fluid flows through the screen-out barrier, additional proppant will collect at the screen-out barrier. The screen-out barrier will thereby greatly reduce or stop the rate of growth in the horizontal direction. In contrast, the bottom of the fracture transition fluid 200 will push down on the top of the fracture propagation fluid 188 and will not experience screen-out. Near the wellbore and all along the fracture, in this transition zone below the start of adding proppant, the fracture width is so wide (e.g., from 0.3" to 0.4" or wider) that the proppant can not screen out to stop the vertical downward growth. Accordingly, the fracture 194 will continue to grow vertically downward but not horizontally outward.

Figures 10, 11A, 11B, 11C, 11D:
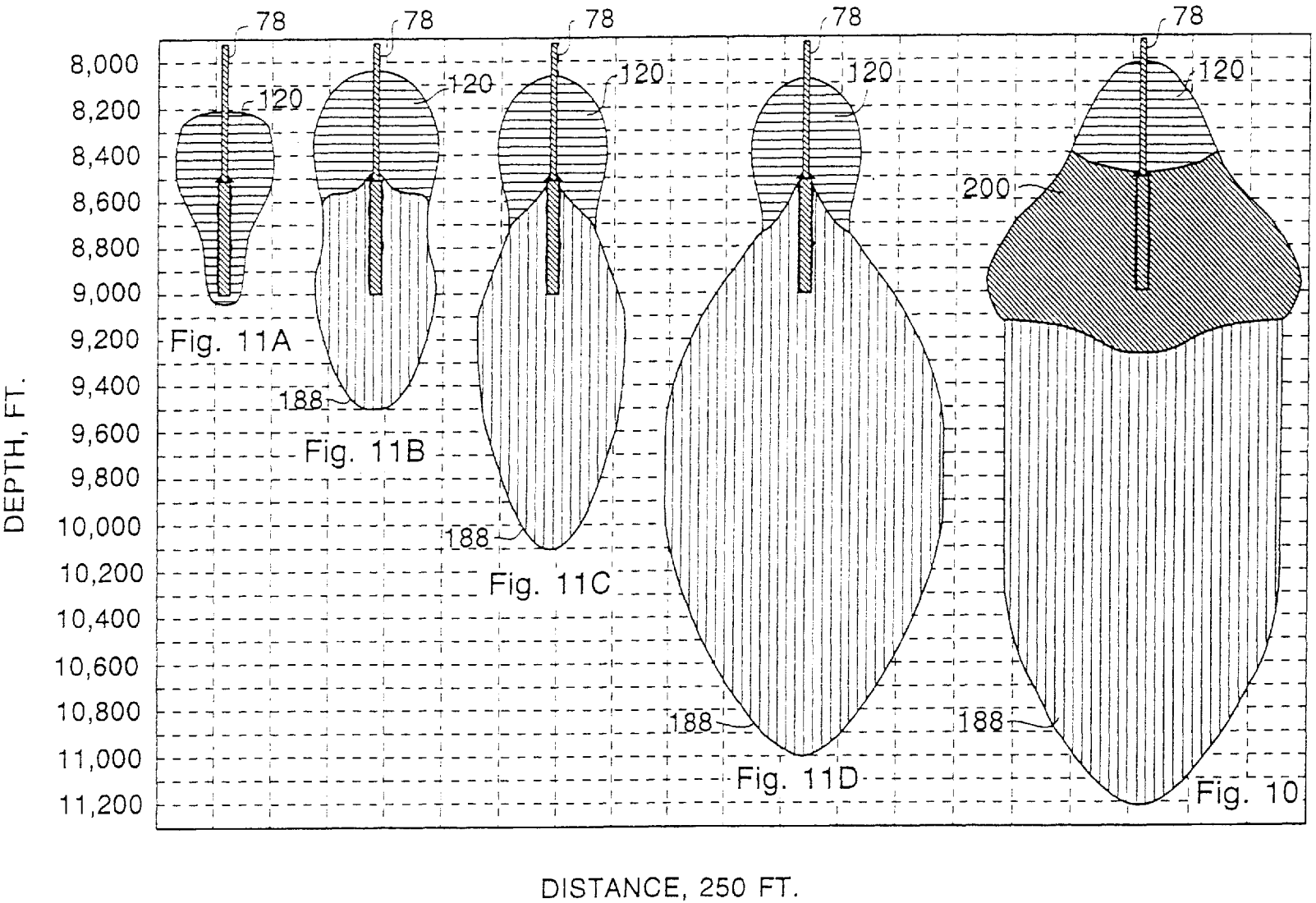

FIG. 11 is a composite overview depicting FIGS. 9A–D and 11 side-by-side. The overview shows the steady downward progression of the fracture over time as the fracture propagation and transition fluids are introduced into the well 78.

A proppant slurry (i.e., fracture packing fluid) (not shown), like that employed in the first embodiment, can be introduced into the well 78 to pack the fracture with proppant. The preferred proppant is a conventional proppant sand or other proppant as desired.

The proppant content of the fracture packing fluid is preferably changed over time in response to a change in the proppant size. The preferred maximum proppant concentration is no more than about 45% by volume.

The proppant causes the fracture packing fluid to have a moderate specific gravity and pressure gradient in the wellbore and a medium viscosity. The specific gravity preferably ranges from about 1.60 to about 1.75. The fluid pressure gradient in the wellbore preferably ranges from about 0.70 to about 0.76 psi/ft.

The fracture proppant slurry acts to substantially minimize growth in the horizontal direction of the fracture. In the event that the fracture-tip screen-out barrier noted above breaks down or is displaced as the fracture width grows, the proppant in the fracture proppant slurry will quickly reseal, replace, or reinforce the barrier to prevent or substantially minimize further growth in the horizontal fracture direction 122.

Fluid loss from the fracture packing fluid will not cause the proppant to settle out of the fluid. The filter cake barrier formed by the proppant in the fracture propagation fluid will prevent, or substantially minimize, the loss of fracture fluid from the fracture packing fluid as it flows through the fracture, except in the very limited area of fracture-tip growth beyond the area previously contacted by the fracture propagation fluid. Any such fluid loss will cause placement of proppant at the fracture tip and thereby accentuate and reinforce the barrier at the fracture tip as noted above.

The limited growth in the horizontal direction will cause an increase of growth in the vertical direction. The fracture proppant slurry will force the fracture propagation and fracture transition fluids downwards and the fracture will propagate to a greater depth.

A well completion fluid (not shown), which was not employed in the first embodiment, can be introduced into the well 78 to pack the shallower portions of the fracture with a tail-in proppant. The proppant content of the fracture proppant slurry preferably ranges from about 35 to about 45% by volume.

The preferred tail-in proppant is either CARBO-PROPO or sintered bauxite proppant. The tail-in proppant in the wellbore packing fluid has a size preferably ranging from about 12 to about 20 mesh (Tyler) and more preferably from about 16 to about 20 mesh (Tyler). Any suitable gelling agent can be included in the fluid to suspend/disperse the tail-in proppant.

Figure 12:
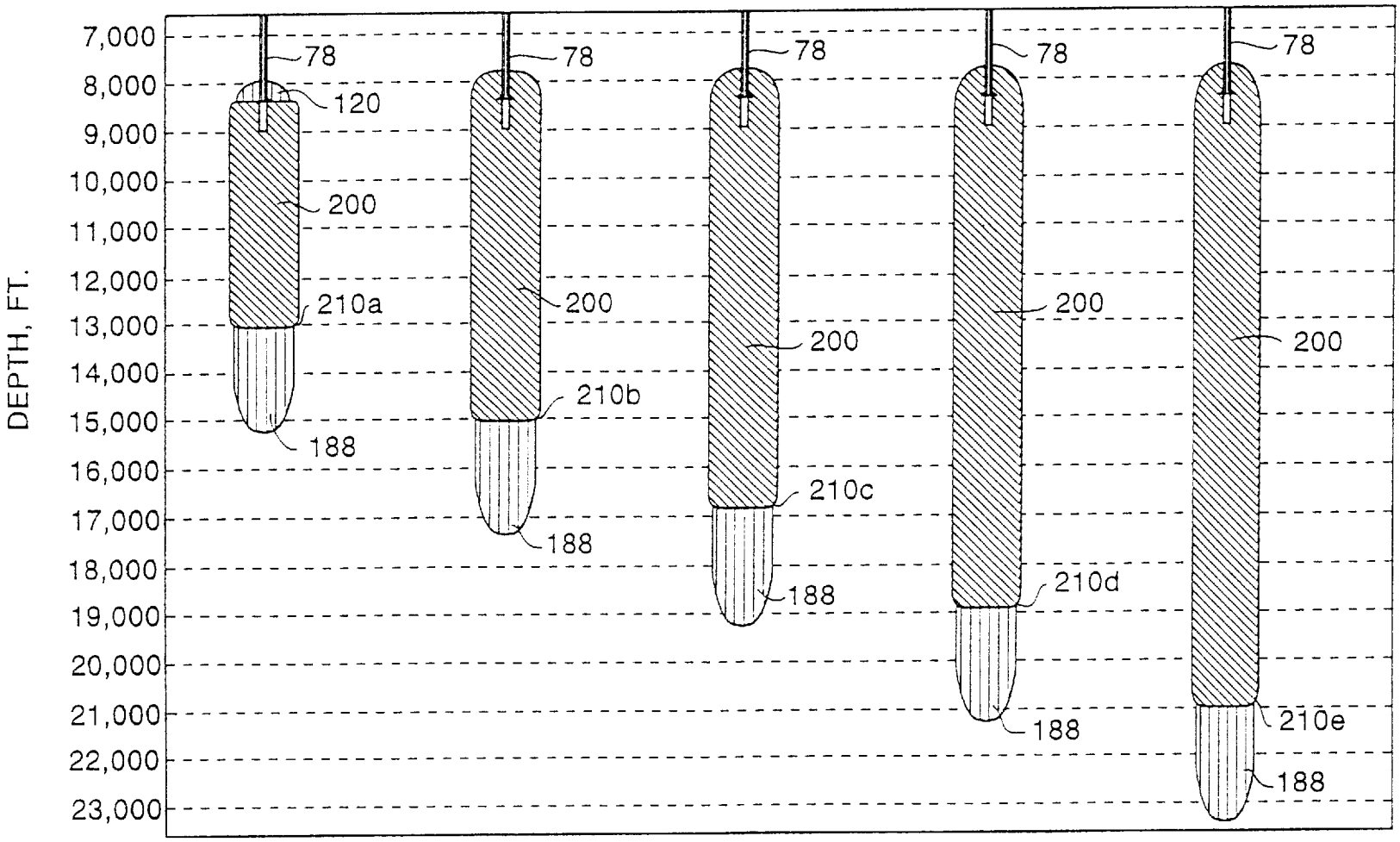
FIG. 12 depicts the propagation of the fracture in the second embodiment at various stages of introduction of the fracture transition fluid.

FIG. 12 illustrates the downward progression of the fracture over time. The transition 210 between the fracture transition fluid 200 and fracture propagation fluid 188 is shown at various points 210*a–c*.

The proper placement of the proppants in the various fluids along the fracture depends upon the relationship of the proppant injection time to the time and sequence of breaking the various gelling agents in the various fracturing fluids described above. The gelling agents must be broken in the proper sequence to cause the proppant to settle out of the fluids sequentially from the bottom of the fracture to the top of the fracture over a designated period of time. The gelling agent breaking time is preferably indexed to the time that the bottom of the fracture packing fluid reaches the desired fracture depth. In other words, the gel breaking process in the fracture proppant slurry begins at the point that the proppant reaches the desired fracture depth and moves progressively upwards. To accomplish this result, the initially injected portions of the fracture proppant slurry will have a gelling agent breaking time that is progressively decreased for later injected portions of the fluid.

The gelling agents in the fracture proppant and fracture transition fluids are preferably timed to break about 5 to about 10 hours or longer after the breaking of the gelling agents in the initially introduced portion of the main fracture proppant slurry.

Figure 13:
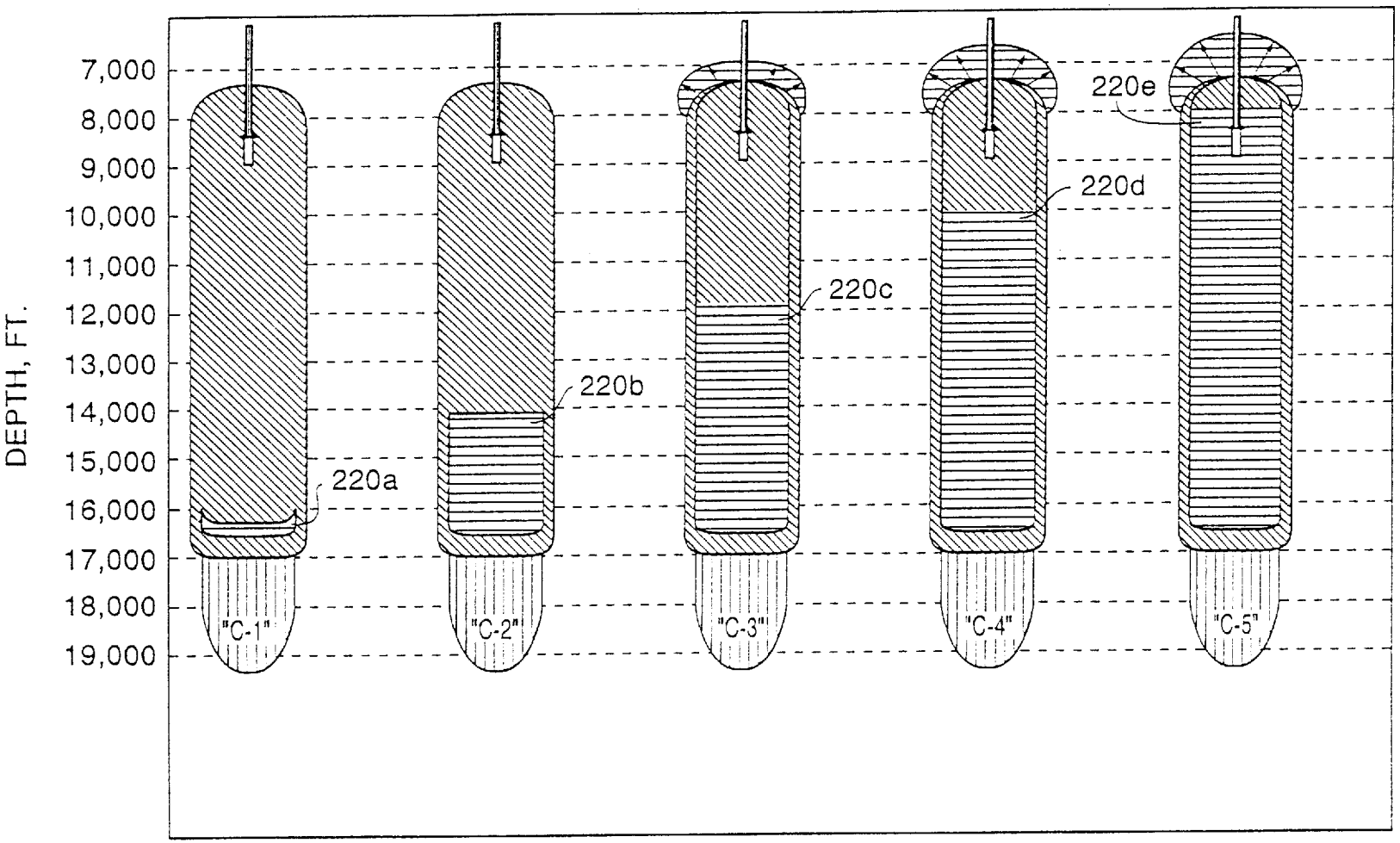
FIG. 13 depicts the gel breaking process in the second embodiment.

FIG. 13 illustrates the gel breaking process. FIG. 13 shows that the fracture continues to propagate downward until the gel is completely broken. The gel breaking interface 220 is shown at various points 220*a–e*.

The use of a fracture transition fluid, and well completion fluid, each having a proppant of progressively larger median sizes, creates a fracture 86 that is sequentially filled with the smallest proppant first and the largest proppant last. This sequential filling of the fractures with progressively larger proppant results in high permeability of the fractures and thereby higher recoveries of fluids from the zones.

After sanding-off of the fractures 86, a completion fluid (not shown) can be circulated through the well 78 to collect the remaining proppant slurry in the wellbore and initiate production of fluids from the fracture and adjacent reservoir zones. The completion fluid can be any light-weight fluid, preferably light-weight nitrogen foam.

EXAMPLE 1

A 12¼ inch hole was drilled to a depth of 2,500 feet. A 9⅝ inch surface casing was then set and cemented in the hole. Then, an 8¾ inch hole was drilled to a total depth of 12,500 feet. A 5½ inch, 23 pound per foot, N-80\C-95 production casing was installed to a total depth of 12,000 feet, leaving about 500 feet of uncased, open hole below the casing. Alternatively, a 6⅝ inch, 32 pound per foot, C-95\P-110 production casing could be installed depending upon well production requirements.

To guide and facilitate the fracture growth, the annulus around the production casing was packed with a high fluid conductivity fracture sand up to the total height desired for the fracture growth. To facilitate the annular proppant pack (i.e., gravel pack), a LYON's hydraulic inflatable casing packer was set at the bottom of the production casing string. A suitable fluid flow port was located above the packer for circulating proppant sand and gelled slurry down the casing and up the annulus above the packer. When the desired volume of proppant slurry had been circulated up the annulus, the fluid flow port was closed. The slurry gel was timed to break sequentially from the bottom to the top of the annular slurry column. The proppant settled out of the slurry to create a continuous annulus proppant pack from the bottom to the top of the interval to be fractured.

After the slurry gel was broken and the proppant had settled in the annulus, the production casing above the annular proppant packed column was cemented to isolate the long gas saturated, fluvial sediment section (i.e., from 7,500 foot to 12,500 foot depth) in the tight sands deposit from the water sands located further uphole. After the emplacement of the proppant pack over the gas saturated section (i.e., from 12,000 foot production casing total depth to about 8,000 feet) and cement over the water saturated section (i.e., above about 7,500 foot depth) were completed, then the casing and the 500-foot open-hole section below the casing were cleaned out preparatory to conducting the hydraulic fracturing. The 500-foot open-hole section below the casing total depth was enlarged by under-reaming or hydraulic jet washing to increase the open-hole diameter and to remove any debris.

The sediments to be fractured were dominantly oleophilic (i.e., preferentially oil-wet) and not hydrophilic (i.e., preferentially water-wet). The oleophilic character of the fluvial sediments correlated with the dominance of multi-valent calcium and magnesium cations adsorbed on the exchangeable cation sites in the clay minerals and other mineral surfaces. The various hydraulic fracturing fluids did not include mono-valent cations (i.e., sodium or potassium) to avoid altering the mineral-surface wettability. The fluids, however, did include multi-valent cations, such as calcium chloride, to further emphasize the oleophilic character of the sediments. In the various fluids, a 0.5% to 2% calcium chloride concentration with the pH adjusted to about pH 10 was employed.

After preparation of the well, 100 barrels of a high viscosity gelled water fracturing fluid were initially injected at a slow rate of about 5 barrels/minute. A single fracture propagated horizontally as a result.

After about 100 barrels of the fracturing fluid was injected at about 5 barrels/minute, about 500 barrels of additional fracturing fluid were injected at about 40 barrels/minute. The consequent increased friction pressure gradient within the fracture as a result of the higher injection rate caused the single fracture to grow outward as well as vertically upward and downward along the open-hole wellbore until it extended a little bit below the bottom of the open-hole wellbore. Since the 0.44 psi/foot static pressure gradient of the gelled water fracturing fluid was only about 50% of the formation's least principal stress fracture extension pressure gradient (i.e., about 0.85 to about 0.9 psi/foot), the resulting buoyancy forces caused the fracture to grow preferentially upward rather than downward.

At the end of injecting the 600 barrels of the gelled water, the fracture had a horizontal length of about 200 feet, a vertical length of about 675 feet and an average width of about 0.3 inches. Thus, the fracture extended from 50 feet below the open-hole to about 125 feet above the top of the open-hole section.

The gel of the first fracturing fluid was broken within about 30 minutes after introduction to yield ungelled water.

A second hydraulic fracturing fluid, having a different composition, was next introduced into the wellbore. A total of 600 barrels of the fluid were introduced. The second fracturing fluid contained 250 tons of 10–16 mesh steel nugget proppant. Volumetrically, the slurry consisted of 70% high viscosity gelled water and 30% steel shot (7.5 specific gravity), yielding a slurry density of 2.97 specific gravity and a static fluid pressure gradient within the fracture of about 1.287 psi/foot. The first 100 barrels of the slurry were pumped at a 10 barrels/minute rate with the remaining 500 barrels being pumped at 40 barrels/minute.

The gel of this proppant slurry was broken within about 10–20 minutes after entering the fracture. The gel breaking agent was activated when the fluid warmed to the reservoir temperature of 220° F. Upon breaking of the gel, the heavy proppant settled to the bottom of the fracture and accumulated over a fracture area of about 100,000 square feet with a proppant porosity of about 40%.

The proppant fallout extended horizontally about 500–600 feet along the bottom of the fracture. At the center of the fracture, the proppant pack extended vertically upward over about 200–300 feet of the wellbore open-hole section. The fracture width was about 0.25 to 0.35 inches and the fracture proppant permeability was about 1,000 darcy or more. The high compressive strength of the proppant prevented significant loss of permeability, even under the high fracture collapse pressures of 10,000–12,000 psi. Consequently, the deposited high permeability proppant provided a high transmissibility flow path for gathering the gas and condensate from the bottom of the fracture and bringing the fluids into the wellbore.

To extend the initial fracture upward to yield the desired vertical extent of the fracture while using a minimum volume of hydraulic fracturing fluid, a low viscosity, low density, spearhead (third) fracturing fluid was injected into the wellbore. The fluid was a 70% quality nitrogen foam (i.e., 70% nitrogen volume measured at 11,000 psi BHP). Approximately 3,000 barrels of the fluid were injected at about 40 barrels/minute to create and propagate the fracture. The fluid had a specific gravity of about 0.645 with a static pressure gradient of about 0.28 psi/foot. The difference between the spearhead fracturing fluid static pressure gradient of 0.28 psi/foot and the formation fracture extension pressure gradient was about 0.6 psi/foot. Benzoic acid crystals were added to the fluid to decrease fluid loss during fracturing.

A high viscosity, gelled water (fourth) fracturing fluid was next introduced into the wellbore. Approximately 2,000 barrels of the high viscosity fluid were introduced into the wellbore at a rate of 40 barrels/minute. The fluid had a viscosity over about 400 Cp. The initial 500 barrels of the fluid increased the fracture width to at least 0.2 inches and, in some cases, over 0.25 inches. The desired fracture width was needed to prevent subsequent proppant-laden fracturing fluids from screening out at the boundary between fluids.

When the fracture reached the desired horizontal length, horizontal fracture propagation was terminated by adding a 35% to 40% volumetric concentration of 16–30 mesh proppant to the fluid. The proppant settled out at the fracture tips to create a fracture tip screen-out as the fracture attempted to grow further in the horizontal direction.

A medium viscosity (i.e., 200–300 centipoise), moderate density (i.e., 1.88 specific gravity, 0.815 psi/foot static pressure gradient) (fifth) fracturing fluid was next introduced into the wellbore. The fluid consisted of 45% proppant and 55% gelled water. The proppant used was a 20–40 mesh sand. Approximately 31,200 barrels of the fluid were injected at the rate of 40 barrels/minute to yield a vertical fracture height of 4,500 feet.

As the fluid flows upward, it will displace the prior injected fluids, thereby continuing to extend the top of the fracture to a greater vertical length. The fluid yielded a fracture width of about 0.35 inches after about 25,000 barrels of the fluid were introduced into the wellbore.

Figure 14:
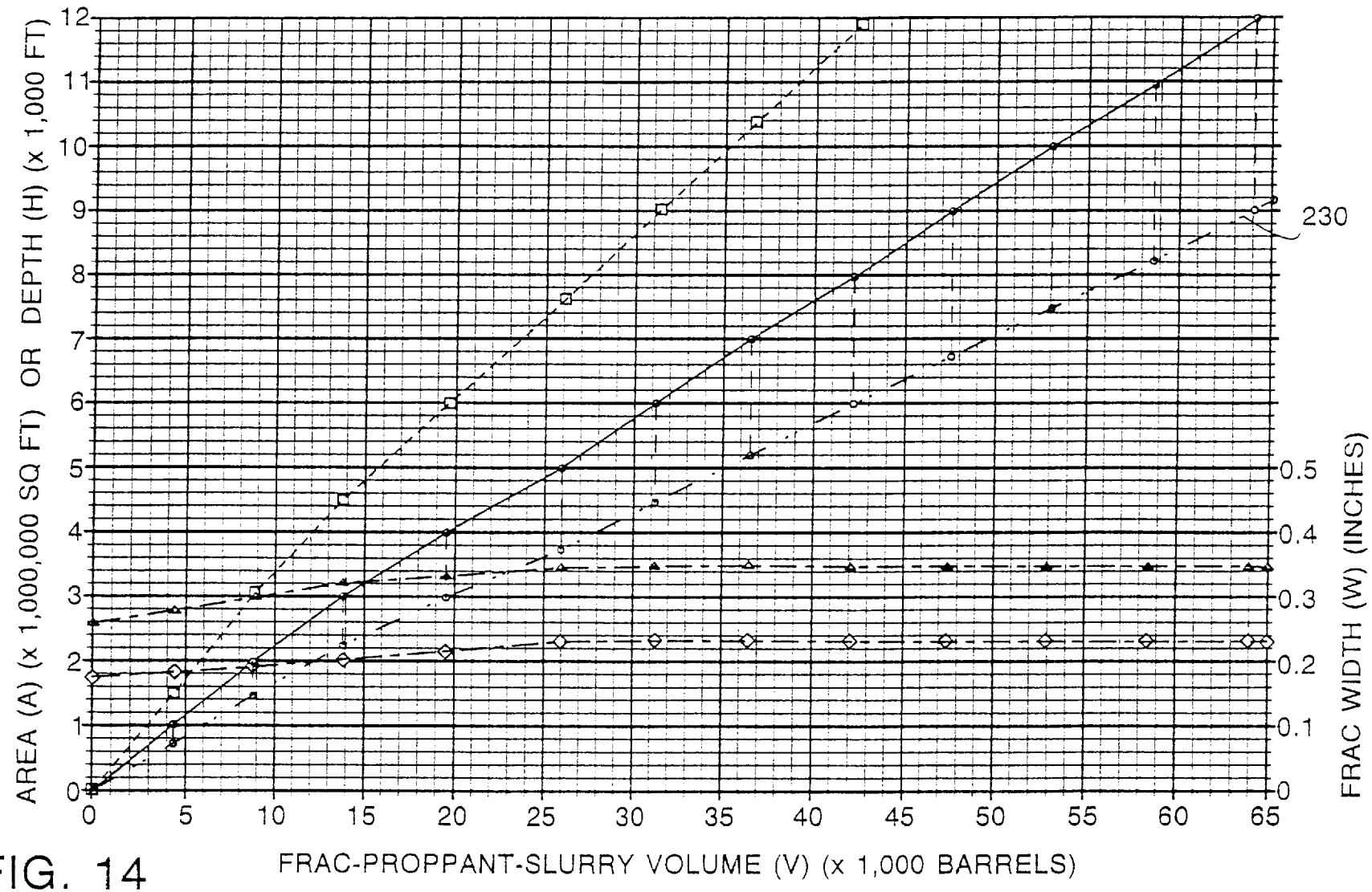
FIG. 14 is a plot of fracture depth, width, and area against fracturing fluid volume in experiment 1.

FIG. 14 illustrates these results. The vertical dotted line labeled "Proppant Height Lost (after breaking gel)" and projected downward from the solid depth/volume line at each 1,000 foot interval represents the volume of water liberated from the fluid as the gel breaks and the proppant falls to the bottom of the fracture where it accumulates. The dotted/dashed line 230 connects the heights of propped fracture after the proppant settled out of the fluid when the fluid gel was broken. The water liberated from the fluid as the gel was sequentially broken from the bottom to the top of the fracture flowed upward in a counter-current fashion to the proppant falling downward.

The initiation of the hydraulic fracture by slowly pressurizing the 500 foot enlarged open-hole interval created a single, symmetrical hydraulic fracture in the plane perpendicular to the least principal stress axis in the sediments. Accordingly, the process prevented the development of tortuosity problems commonly associated with fracturing through multi-directional perforations in the casing.

TABLE 1

Summary of Materials Used in Fracturing Fluids

| IDENTITY OF FLUID | TOTAL (BARRELS) | WATER (BARRELS) | NITROGEN (BARRELS) | PROPPANT (TONS) | PUMPING HOURS |
|---|---|---|---|---|---|
| First Fracturing Fluid | 600 | 600 | 0 | 0 | 0.54 |
| Second Fracturing Fluid | 600 | 420 | 0 | 250 | 0.50 |
| Third Fracturing Fluid | 3,000 | 900 | $4.6 \times 10^6$ Scf | 0 | 1.25 |
| Fourth Fracturing Fluid | 2,000 | 1,325 | 0 | 348 | 0.83 |
| Fifth Fracturing Fluid | 31,200 | 17,160 | 0 | 7,231 | 13.0 |
| TOTALS | 37,400 | 20,405 | $4.6 \times 10^6$ Scf | 7,829 | 16.1 |

EXAMPLE 2

The well was prepared for the various hydraulic fracturing fluids in the manner described in Example 1.

After preparation of the well, 100–300 barrels of high viscosity, gelled water fracturing fluid were initially introduced into the well at a slow rate of about 5 barrels/minute. About 3,700 to 3,900 barrels of high viscosity gelled water were next injected at the highest permissible pump rate (i.e., 60 barrels/minute) to cause the fracture to grow radially symmetric as a vertical penny-shaped fracture. The fracture propagated across intervening and highly resistant shale layers.

The fracture had a width of 0.5 inches, extended from about 350 feet above the top of the open wellbore to about 350 feet below the bottom of the open wellbore, and extended horizontally about 700 feet (i.e., 350 feet from each side of the wellbore). Thus, the fracture was about 900 feet high, 700 feet long and about 0.5 inches wide.

A second hydraulic fracturing fluid, which was ungelled water, was injected at the rate of 20 barrels/minute. The ungelled water combined with the water from the first fracturing fluid, which had its gel broken prior to introduction of the second hydraulic fracturing fluid, to propagate the fracture vertically upward. Approximately 3,500 barrels of the ungelled water were introduced into the well to provide a 7,500 barrel water spearhead to propagate upward fracture growth.

The resulting fracture had a vertical height of about 1,800 to about 2,000 feet, a horizontal length of about 700 to about 1,000 feet, and a fracture width of about 0.15 to about 0.18 inches.

Next, 5,000 barrels of the high viscosity (third) fracturing fluid of Example 1 were introduced.

Finally, a high viscosity, moderate density, fourth fracturing fluid containing a proppant was introduced. The fourth hydraulic fracturing fluid, like the third hydraulic fracturing fluid, caused additional displacement of the first and second fracturing fluids, thereby further increasing vertical growth of the fracture.

The final propped fracture had a vertical height of about 4,000 to about 5,000 feet, an average horizontal length of about 1,000 to about 1,500 feet, and an average propped fracture width of about 0.25 to about 0.4 inches.

EXAMPLE 3

The well was prepared for the various hydraulic fracturing fluids in the manner described in Example 1 except that the production casing was cemented in place along its length to the wellbore.

To initiate the fracture, 250 barrels for the 5½ inch production casing (360 barrels for a 7 inch production casing) of a gelled water first fracturing fluid were injected into the wellbore at an injection rate of about 5 barrels/minute. The fluid caused the formation of a single hydraulic fracture near the top of the open-hole section. After about 90–100 barrels of the fluid were injected at about 5 barrels/minute, the fracture extended outward about 175 feet and upward about 200 feet and downward about 75 feet. The injection rate was then increased gradually from 5 barrels/minute up to about 40 barrels/minute. The resulting increased friction pressure within the fracture caused the fracture to grow downward along the open wellbore until it extended a little bit below the bottom of the wellbore.

To extend the initial fracture downward to achieve maximum depth penetration with minimum hydraulic fracturing fluid injection, a special, low viscosity, high density, spearhead second fracturing fluid with a high static pressure gradient of 1.3 psi/foot and a specific gravity of 3 was injected into the fracture. The high density of the fluid was achieved by suspending a −325 mesh (i.e., 325–600 mesh) high density, crushed mineral powder plus a 50–150 mesh cast iron shot/grit ballast in a low viscosity polymer-dispersant-water solution. The 325–600 mesh mineral powder, plus the 50–150 mesh cast iron shot/grit ballast, built a filter cake over any permeable porosity zone to greatly reduce any fluid loss from the fluid. In later steps, the filter cake acted as a very effective fluid loss preventative, thereby giving a very high effectiveness of propagating the fracture with very little loss of the fracturing fluid.

The fluid was introduced according to the following injection pumping schedule:

(i) inject the first 500 barrels at 5 barrels/minute;
(ii) inject the next 500 barrels at 10 barrels/minute;
(iii) inject the next 1,000 barrels at 15 barrels/minute;
(iv) inject the next 1,000 barrels at 20 barrels/minute;
(v) inject the last 1,000 barrels at 30 barrels/minute.

The viscosity of the fluid was less than 100 centipoise.

The fluid caused the fracture to propagate vertically downward continuously at a rate of about 340 feet per hour. The resulting fracture had dimensions of about 0.15 inches wide by 1,400 feet horizontal length, yielding a vertical flow cross-sectional area of about 17.5 square feet.

The fluid was prepared by making a moderately high density slurry by dispersing the 325–600 mesh spinel powder in a low viscosity polymer-dispersant-solution. When mixed in the proportions of 35% by volume powder dispersed in 65% polymer-dispersant-solution, the resulting low viscosity slurry had a density of 2.386 and a 1.033 psi/foot static pressure gradient. Next, the 50–150 mesh cast iron shot/grit with a specific gravity of about 7.5 was added to the slurry. The resulting fluid consisted of 12.5% by volume cast iron shot/grit, 30.6% by volume of the spinel powder, and 56.9% by volume of the polymer-dispersant-solution.

Two thousand barrels of a high viscosity (i.e., over 400 Cp), high density third fracturing fluid were introduced into the well at a rate of 30 barrels/minute. The concentration of the proppant, a 16–30 mesh cast iron shot, was gradually increased during introduction of the fluid. First, a 10% volume of 50–150 mesh cast iron ballast was dispersed in the fluid to give a fluid density (with ballast) of 1.68 specific gravity with a 0.727 psi/foot pressure gradient. The initial 300 barrels of the fluid were injected without any proppant. The next 700 barrels of fluid had a gradually increasing concentration of a 16–30 mesh proppant until a concentration of 45% proppant was realized. The final 1,000 barrels of the fluid consisted of 45% of the 16–30 mesh proppant dispersed in the fluid. In all stages, the fluid contained the 50–150 mesh cast iron ballast. The final 1,000 barrels of the fluid had a high viscosity, exceeding 400 centipoise, and a specific gravity of 2.25 with a 0.973 psi/foot static pressure gradient. The fluid increased the fracture width from about 0.15 to about 0.25 inches or more. The proppant was suspended in the fluid using a hydroxyethylcellulose dispersing/suspending gelling agent.

The fluid not only increased the fracture width but also increased the vertical length of the fracture. The horizontal length, however, was limited in growth due to the 16–30 mesh proppant causing a screen-out at the fracture tips. The horizontal length of the fracture after the introduction of the fluid ranged from about 1,200 to about 1,400 feet.

Next, approximately 56,000 barrels of a medium viscosity (i.e., 200–300 centipoise), moderate density (i.e., 1.88 specific gravity, 0.815 psi/foot pressure gradient), fourth fracturing fluid was introduced into the well at the rate of 30 barrels/minute. The fluid was 45% proppant and 55% gelled water. The proppant was a 16–30 mesh proppant sand.

The fluid caused a downward displacement of the previously injected fracturing fluids, thereby continuing to extend the bottom of the fracture to even greater depths. As described previously, the horizontal growth of the fracture was limited by the proppant barrier existing along the fracture tip.

Figure 15:
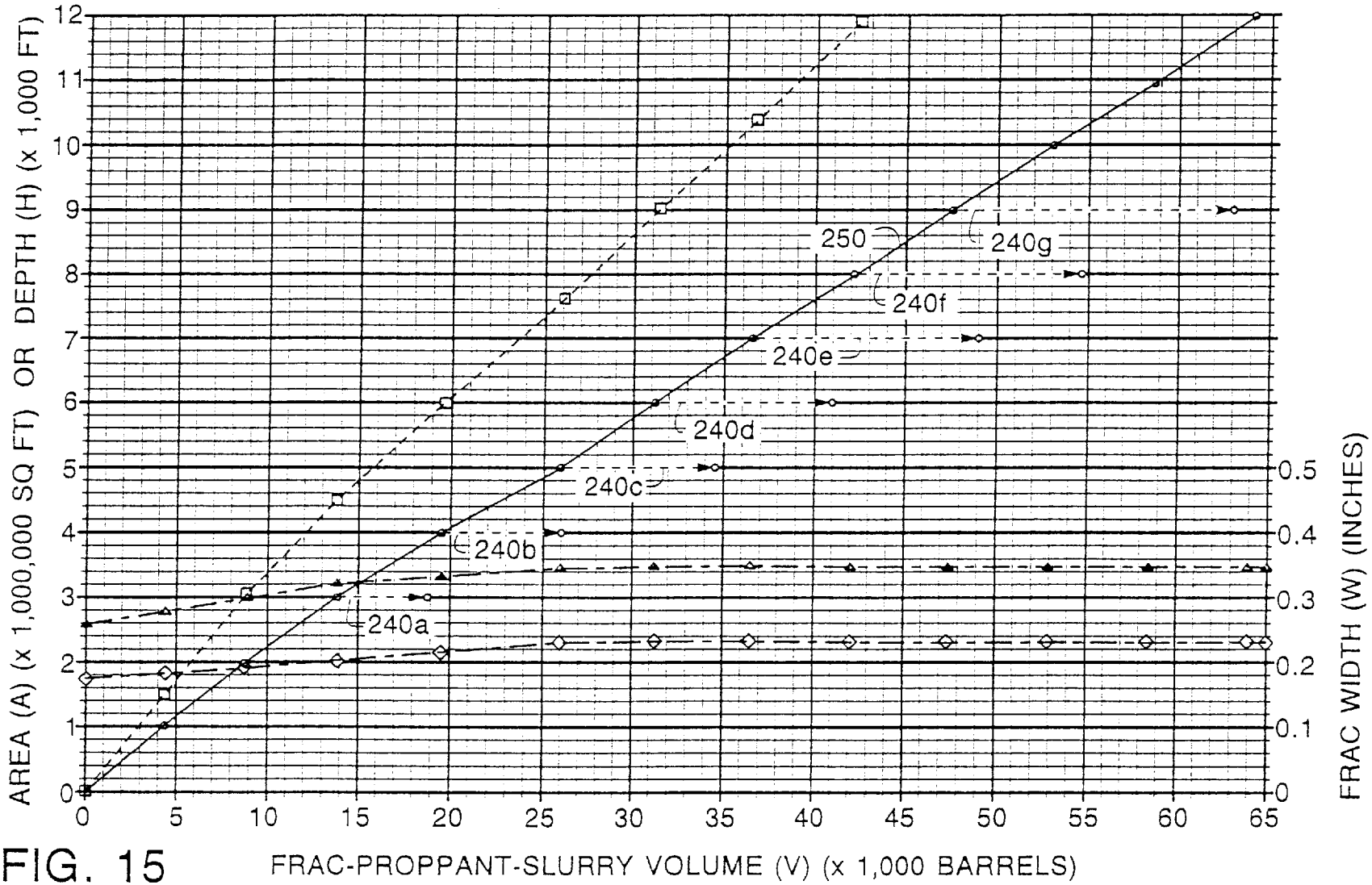
FIG. 15 is a plot of fracture depth, width, and area against fracturing fluid volume in experiment 2.

The growth of the vertical and horizontal lengths of the fracture and the fracture area as a function of the injected volume of the fourth fracturing fluid is illustrated in FIG. 15. The horizontal fracture length is assumed to remain a constant 1,500 feet. Also, the fracture width is assumed to remain nearly constant after reaching about 0.35 inches at 25,000 barrels of the fourth fracturing fluid were injected. At this point in time, the fracture has a vertical flow, cross-sectional area of about 29–30 square feet. Note especially the dotted line projections 240*a–g* from the solid depth/volume line 250 at each 1,000 foot interval labeled "Volume Added After Breaking Slurry Gel." The dotted line extension 240 at each 1,000 foot interval represents the volume of water liberated from the fourth fracturing fluid as the gelling agent is broken and the proppant falls to the bottom of the fracture to build upward the proppant-packed portion of the fracture. The water liberated from the slurry as the gelling agent is sequentially broken from the bottom of the fracture to the top will flow upward in a counter-current fashion (i.e., the water will flow counter-current to the settling proppant).

Finally, 300 barrels of a tail-in proppant fifth fracturing fluid containing 54 tons of high permeability, high crushing strength, 16–20 mesh CARBO-PROPO or sintered bauxite proppant (i.e., 40% of slurry volume) suspended in gelled water were introduced into the wellbore at a rate of 30 barrels/minute. The gelling agent was broken about 5 minutes after introduction of the fluid into the sediments.

The natural gas flowing upward through the 30 square feet of cross-sectional area of the fracture (i.e., 1,500 feet horizontal length by 0.02 feet average fracture width) of the packed proppant from the third fracturing fluid was collected and channeled through the packed tail-in proppant to the 500 feet of open-hole wellbore wall. The 500 feet of fracture opening into the open-hole wellbore had a cross-sectional area of about 10 square feet (i.e., 500 feet high by 0.02 feet wide). At an 8,000 psi fracture closure pressure, the tail-in proppant had a retained permeability of about 400 darcy over the 10 square foot area of the fracture entry into the open-hole wellbore, resulting in about 4,000 darcy-square-foot fluid transmissibility. Likewise, at about 8,000 psi fracture closure pressure, the packed proppant from the third fracturing fluid had a retained permeability of about 7 darcy. The 7 darcy permeability in the 30 square foot, horizontal cross-sectional area of the fracture proppant resulted in about 200 darcy-square-foot fluid transmissibility from the packed proppant into the packed tail-in proppant. Consequently, the packed tail-in proppant effectively collected the natural gas flowing upward through the 200 darcy-square-foot transmissibility of the packed proppant from the third fracturing fluid and transmitted the gas into the wellbore through a 4,000 darcy-square-foot transmissibility packed tail-in proppant fracture pack.

The fifth fracturing fluid was introduced when the previously introduced fourth fracturing fluid was close to sand-off of the wellbore. The tail-in proppant had a higher fluid transmissibility than the proppant in the fourth fracturing fluid and thereby enhanced flow of the gas from the fracture into the wellbore for collection.

In another experiment, additional amounts of the fourth fracturing fluid having a very short gel-breaking time were continued until a total sand-out was realized. In this experiment, the fifth fracturing fluid was not introduced into the wellbore. This configuration is sometimes preferable because it is often difficult to estimate accurately when the wellbore is close to sand-off from the fourth fracturing fluid.

Figure 16:
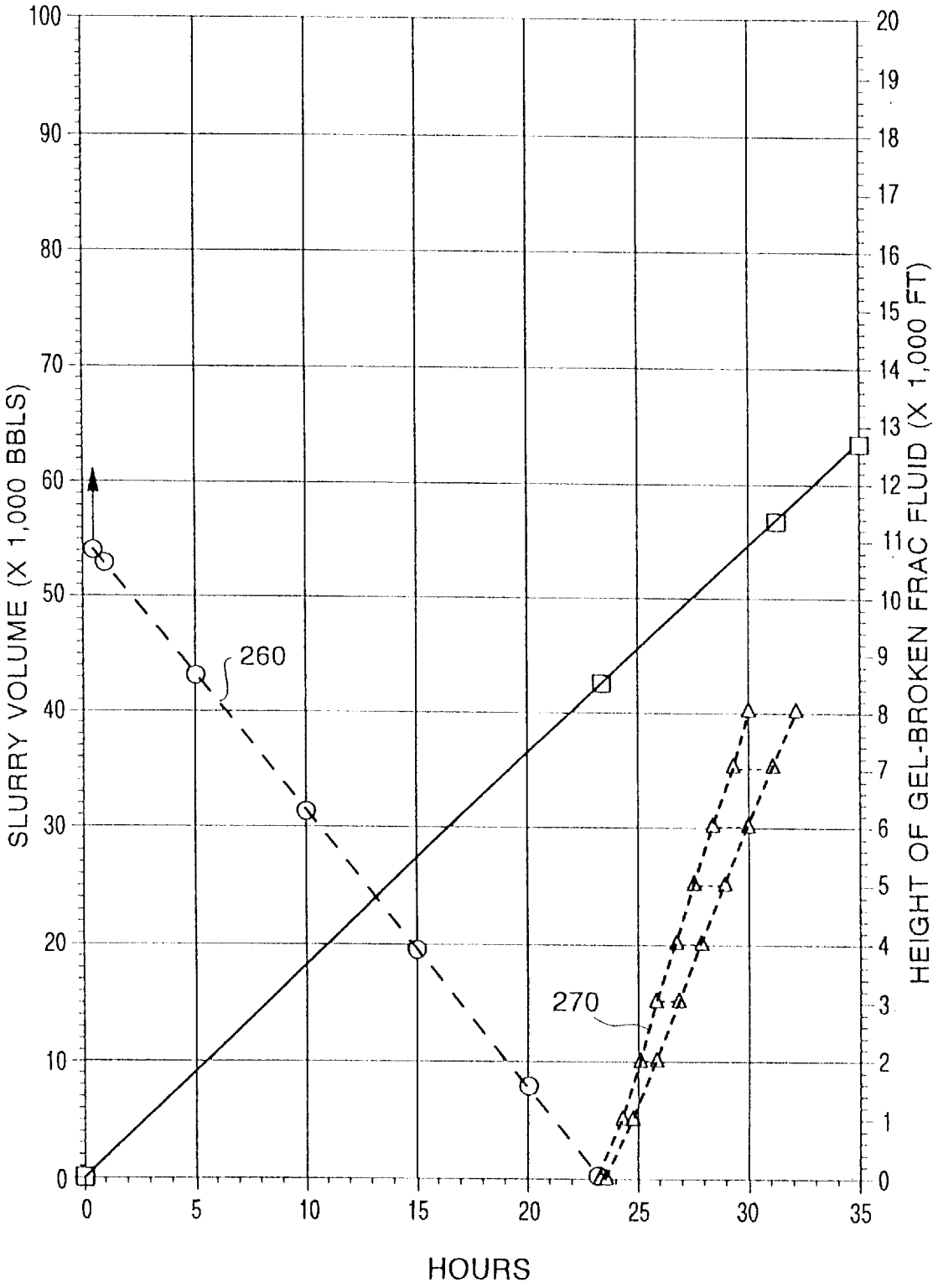
FIG. 16 is a plot of fracturing fluid volume and height of gel-broken fracturing fluid against time for experiment 2.

FIG. 16 depicts the relationship between gelling agent breaking time (horizontal axis) and the total volume of the fourth fracturing fluid introduced into the wellbore and the desired fracture depth (vertical axis). For the desired fracture depth of 8,000 feet below the bottom of the production casing, the gel breaking time for the initially injected portion of fourth fracturing fluid was about 23.3 hours. In other words, the fourth fracturing fluid will reach the depth of 8,000 feet below the bottom of the production casing in about 23.3 hours. The gelling agent breaking time decreased progressively from the 23.3 hours at the start of the injection of the fourth fracturing fluid down to 0.5 hours after injecting 54,000 barrels of the fluid as shown by the dotted line 260.

The gelling agent breaker employed considered the temperature gradient existing along the vertical length of the fracture and the cooling of the gradient as the various fluids moved through the fracture. The gel breaking in the fourth fracturing fluid preferably began at 23.3 hours and then sequentially progressed to higher elevations as shown by the dotted line 270. After about 7 hours and 12,000 barrels of fourth fracturing fluid injection, the gelling agent in all of the injected fifth fracturing fluid was broken. The sequential gel-breaking of the fifth fracturing fluid allowed the proppant to settle and fill the fracture volume from the bottom to the top of the fracture over the 7-hour gel-breaking time interval.

After completing the 54,000 to 56,000 barrels of fourth fracturing fluid injection with sequentially timed gelling agent breaking to fill the fracture from the bottom up with gravity settled proppant, additional amounts of fourth fracturing fluid with a gelling agent breaking time of 0.5 hours after entry into the formation was continued until a near sand-off condition was achieved. At that point, the fifth fracturing fluid was introduced.

The gelling agent breakers in the second fracturing fluid and the third fracturing fluid were timed to break about 1 or 2 hours before the breaking of the gel in the initial portion of the fourth fracturing fluid. The gelling agent in the first fracturing fluid broke about 8–10 hours after injection.

Table 2 presents a summary of the various hydraulic fracturing fluids used.

TABLE 2

Summary of Materials Used in Hydraulic Fracturing Fluids

| IDENTITY OF FLUID | TOTAL (BARRELS) | WATER (BARRELS) | PROPPANT (TONS) |
|---|---|---|---|
| First Fracturing Fluid | 360 | 360 | 0 |
| Second Fracturing Fluid | 4,000 | 2,276 | 1,663 |
| Third Fracturing Fluid | 2,000 | 1,193 | 522 |
| Fourth Fracturing Fluid | 56,000 | 30,800 | 12,978 |
| TOTALS | 62,360 | 34,629 | 15,163 |

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method for fracturing multiple subterranean zones to collect fluids from one or more of the zones through a wellbore, comprising the steps of:

introducing a fracturing fluid into a wellbore to propagate a substantially vertically oriented fracture in a dominantly upward direction, the zone being at a depth at which natural in-situ stresses favor the initiation of a vertical fracture in the zone, wherein the fracturing fluid has a static fracture fluid pressure gradient and the magnitude of the static fracture fluid pressure gradient is less than an average fracture extension pressure gradient of the zone to be fractured.

2. The method, as claimed in claim 1, wherein in the zone to be fractured an axis of least principle in-situ stress is substantially horizontal resulting in the fracture having a substantially vertical orientation that is substantially normal to the horizontal axis of the least principle in-situ stress.

3. The method, as claimed in claim 1, wherein static fracture fluid pressure gradient is no more than about 65% of the average fracture extension pressure gradient.

4. The method, as claimed in claim 3, wherein the primary growth direction of the vertical fracture is caused to be upwardly by using a fracturing fluid having an average viscosity of less than about 100 Cp and an average injection rate of less than about 40 bpm.

5. The method, as claimed in claim 1, wherein the fracturing fluid has an introduction rate that is no more than about 35 bpm to increase the ratio of fracture growth vertically to fracture growth horizontally.

6. The method, as claimed in claim 1, wherein the fracturing fluid comprises gelled water and is substantially free of a proppant.

7. The method, as claimed in claim 1, wherein the fracturing fluid has an average viscosity that is no more than about 50 Cp.

8. The method, as claimed in claim 1, wherein the average static fracture fluid pressure gradient in the wellbore ranges from about 0.25 to about 0.58 psi/ft to extend the fracture in an upward direction.

9. The method, as claimed in claim 8, further comprising, after the introducing step, passing a second fracturing fluid having a different composition than the fracturing fluid, through the wellbore, wherein the second fracturing fluid has an average introduction rate that is no more than about 20 bpm.

10. The method, as claimed in claim 8, further comprising, after the introducing step, passing a second fracturing fluid having a different composition than the fracturing fluid, through the wellbore, wherein the second fracturing fluid has an average viscosity that is no more than about 50 Cp.

11. The method, as claimed in claim 1, wherein the average static fracture fluid pressure gradient in the wellbore ranges from about 1.10 to about 1.40 psi/ft to extend the fracture in a downward direction.

12. The method, as claimed in claim 11, further comprising, after the introducing step, passing a second fracturing fluid having a different composition than the fracturing fluid through the wellbore, wherein the second fracturing fluid has an average viscosity that is no more than about 100 Cp.

13. The method, as claimed in claim 1, wherein the fracturing fluid has an average viscosity that is less than about 20 Cp, an average injection rate that is less than about 20 bpm and an average static pressure gradient that is less than about 35% of the fracture extension pressure gradient to increase the ratio of the fracture upward growth rate to the fracture horizontal growth rate.

14. The method, as claimed in claim 1, wherein the fracturing fluid's physical properties are changed (a) to increase the ratio of the fracture upward growth rate to the fracture horizontal growth rate by decreasing the fracturing fluid density, the fluid viscosity, or the fluid injection rate or by decreasing any combination of those three properties of the fracturing fluid or (b) decreasing the ratio of the fracture upward growth rate to the fracture horizontal growth rate by increasing the fracturing fluid density, the fracturing fluid viscosity, or the fracturing fluid injection rate or by increasing any combination of these three properties of the fracturing fluid.

15. The method, as claimed in claim 1, further comprising, after the introducing step, passing a second fracturing fluid having a different composition than the fracturing fluid, through the wellbore, wherein the second fracturing fluid comprises a gel to cause suspension of a proppant in the second fracturing fluid and a gel-breaking agent to cause the proppant to deposit in the fracture.

16. The method, as claimed in claim 1, further comprising at least partially filling an annulus defined by the wellbore and a conduit positioned within the wellbore with a granulated solid material that has a fluid conductivity to provide a continuous path of fluid flow in the annulus extending across a plurality of adjacent lithologic zones and thereafter passing the fracturing fluid through the granulated solid material in the annulus to propagate the fracture.

17. The method, as claimed in claim 1, wherein a conduit is located in an upper portion of the wellbore and below the conduit the wellbore includes an open hole, with the fracture extending from the open hole.

18. The method, as claimed in claim 1, wherein a moderate-loss-shunt by-pass path along the wellbore wall is created to permit the fracturing fluid to by-pass a difficult-to-penetrate fracture barrier formation which otherwise would inhibit the upward migration of the fracture, thereby permitting the fracturing fluid to flow around the fracture barrier formation and through the moderate-loss-shunt by-pass path to initiate a second vertical fracture in a formation above the fracture barrier formation and/or to initiate fractures in laminated lithologic layers within such fracture barrier formation exposed to the moderate-loss-shunt by-pass path, thereby causing the fracture barrier formation to break down and propagate the upward growing vertical fracture into and through the formation above the fracture barrier formation.

19. The method, as claimed in claim 18, wherein the moderate-loss-shunt by-pass path along the wellbore wall is created by at least partially filling the annulus defined by the wellbore and a conduit positioned within the wellbore with a granulated solid material that has a fluid conductivity to provide a continuous path of fluid flow in the annulus extending across a plurality of adjacent lithologic zones.

20. The method, as claimed in claim 19, wherein the granulated solid material at least partially filling the annulus is created by a gravel pack of selected grain-size sand.

21. The method, as claimed in claim 20, wherein the sand grains in the gravel pack are coated by any of the normally available sand grain coatings, causing the sand grains to stick together to create a non-mobile, consolidated sand pack in the annulus.

22. The method, as claimed in claim 1, wherein a preliminary vertical fracture extending nearly symmetrically upward, outward, and downward for a distance of at least 150 feet from a fracturing fluid injection zone is created to thereby facilitate and improve upward fracture growth performance.

23. The method, as claimed in claim 1, further comprising introducing a fracture initiation fluid into the wellbore, the fracture initiation fluid having a viscosity of no less than about 500 Cp and an introduction rate of more than about 35 bbls/min.

24. A method for fracturing multiple subterranean zones to collect fluids from one or more of the zones through a wellbore, comprising the steps of:

(A) forming a well extending from the surface to a point above the zone to be fractured;

(B) passing a fracturing fluid through the well to initiate a substantially vertical fracture at a bottom of the well and thereafter extending the fracture in a dominantly downwardly direction below the bottom and into the zone, wherein the fracturing fluid defines an average static fracture fluid pressure gradient and the magnitude of the average static fracture fluid pressure gradient is more than the average fracture extension pressure gradient to propagate the fracture in the downward direction.

25. The method, as claimed in claim 24, wherein the fracturing fluid has a viscosity of no more than about 100 Cp and a low pumping rate to provide a rate of fracture growth vertically that is more than a rate of fracture growth horizontally.

26. The method, as claimed in claim 25, wherein the fracturing fluid has a pumping rate of less than about 35 barrels/min.

27. The method, as claimed in claim 24, wherein at least one of the fracturing fluid pumping rate and the fluid viscosity is selected to provide a desired ratio of fracture growth horizontally to fracture growth vertically.

28. The method, as claimed in claim 24, wherein the rate of fracture growth horizontally is directly related to the fracturing fluid pumping rate and the fluid viscosity and the rate of fracture growth vertically is indirectly related to the fracturing fluid pumping rate and the fluid viscosity.

29. The method, as claimed in claim 24, wherein the fracturing fluid includes a proppant having a specific gravity of no less than about 4.

30. The method, as claimed in claim 24, wherein a conduit is located in an upper portion of the wellbore and below the conduit the wellbore includes an open hole, with the fracture extending from the open hole.

31. The method, as claimed in claim 24, wherein the primary growth direction of the vertical fracture is caused to be in the downward direction by using a fracturing fluid with a static pressure gradient of no less than about 120% of the average rock formation fracture extension pressure gradient and with an average viscosity of less than about 100 cp and an average injection rate of less than about 40 bpm.

32. The method as claimed in claim 24, wherein the fracturing fluid has an average viscosity that is less than about 20 cp, an average injection rate that is less than about 20 bpm, and an average static pressure gradient that is no less than about 140% of the fracture extension pressure gradient to thereby increase the ratio of the fracture downward growth rate to the fracture horizontal growth rate.

33. The method, as claimed in claim 24, wherein the fracturing fluid's physical properties are changed (A) to increase the ratio of the fracture downward growth rate to the fracture horizontal growth rate by (1) increasing the fluid density, (2) decreasing the fluid viscosity, or (3) decreasing the fluid injection rate, or by proportionally changing any combination of these three properties of the fracturing fluid, or (B) to decrease the ratio of the fracture downward growth rate to the fracture horizontal growth rate by (1) decreasing the fluid density, (2) increasing the fluid viscosity, or (3) increasing the fluid injection rate, or by proportionally changing any combination of these three properties of the frac fluid.

34. The method, as claimed in claim 24, wherein a preliminary vertical fraction intending nearly systematically upward, outward, and downward for a distance of at least about 150 feet from the frac fluid injection zone so created to thereby facilitate and improve the downward frac growth performance.

35. The method, as claimed in claim 24, wherein the fracturing fluid contains an additive that causes the mineral grain surfaces in the formation rock to retain approximately the same oleophilic/hydrophilic wettability character as existed prior to their contact with said fracturing fluid.

36. A method for fracturing multiple adjacent subterranean zones to collect fluids from one or more of the zones through a wellbore, comprising the steps of:

(A) attaching no more than a portion of a conduit contained in the wellbore to the walls of the wellbore to define an open annulus between the walls of the wellbore and the conduit, wherein at least most of the outer wall of the open annulus is an exposed face of the zones to be fractured;

( B) placing a free-flowing, granulated, solid material that is substantially permeable to fluid flow in at least a portion of the open annulus to provide by-pass path in the annulus to permit a fracturing fluid to follow the by-pass path around a fracture resistant lithologic formation in the zones and thereby form a fracture on both sides of the lithologic formation and in fracture resistant lithologic formation itself; and (C) thereafter passing a fracturing fluid through the annulus to form a fracture in the zones.

37. The method, as claimed in claim 36, wherein the solid material has a moderate fluid transmissibility in the annulus along at least a portion of the total height of the lithologic formations in the zones.

38. The method, as claimed in claim 36, wherein the ratio of the rate of fracture growth horizontally to the rate of fracture growth vertically is directly related to the injection rate of the fracturing fluid and the fracturing fluid viscosity.

39. The method, as claimed in claim 36, further comprising, after the thereafter passing step, propping open the fracture using a proppant contained in a second fracturing fluid.

40. The method, as claimed in claim 36, wherein the second fracturing fluid is injected into the fracture through an open hole in the wellbore located below the solid material in the annulus.

41. The method, as claimed in claim 36, further comprising introducing a fracture initiation fluid into the wellbore, the fracture initiation fluid having a viscosity of no less than about 500 Cp and an introduction rate of more than about 35 bbls/min.

42. The method, as claimed in claim 36, wherein the fracturing fluid includes water and at least one of dissolved mono-valent cations and multi-valent cations to cause the zones to have substantially the same oleophilic/hydrophilic wettability character both before and after the zones contacted the fracturing fluid.

43. The method, as claimed in claim 36, wherein the fracturing fluid includes additives to cause the zones to become predominantly oleophilic to facilitate the removal of condensate blockages in the zones.

44. The method, as claimed in claim 36, wherein the fracturing fluid is aqueous and contains multi-valent cations to cause the zones to become predominantly oleophilic to facilitate removal of condensate blockages in the zones.

45. A method for fracturing multiple subterranean zones to collect fluids from one or more of the zones through a wellbore, comprising the steps of:

(A) at least partially filling an annulus defined by the wellbore and a conduit contained in the wellbore with a granulated solid material that is substantially conductive to a fluid to provide a path of fluid flow in the annulus extending across a plurality of lithologic formations and (B) thereafter passing a fracturing fluid through at least a portion of the granulated solid material in the annulus to form a fracture in a zone, wherein the zone is at a depth at which original in-situ stresses on the zone favor the initiation of a vertical fracture.

46. The method, as claimed in claim 45, wherein the fracturing fluid passes from the interior of the conduit and into the annulus at a point located below the at least a portion of the granulated solid material.

* * * * *

UNITED STATES PATENT AND TRADEMARK OFFICE

CERTIFICATE OF CORRECTION

PATENT NO. : 5,875,843
DATED : March 2, 1999
INVENTOR(S) : Hill

It is certified that error appears in the above-identified patent and that said Letters Patent is hereby corrected as shown below:

Column 20,
Line 59, please delete “a wellbore” and insert -- the wellbore -- therefor.
Line 62, please delete “the initiation” and insert -- an initiation -- therefor.
Line 64, please delete “and the” and insert -- and a -- therefor.

Column 21,
Lines 2 and 5, please delete “principle” and insert -- principal -- therefor.
Line 6, please insert -- the -- between “wherein” and “static.”.
Line 8, please delete “the primary” and insert -- a primary -- therefor.
Line 15, please delete “the ratio” and insert -- a ratio -- therefor.
Line 24, please delete “an upward” and insert -- the upward -- therefor.
Lines 52 and 56, please delete “the ratio”, “the fracture”, and “to the” and insert -- a ratio --, -- a fracture --, and -- to a --, respectively, therefor.
Line 57, please delete “the fracturing” and insert -- a fracturing -- therefor.
Line 58, please delete “the fluid viscosity”, and “the fluid injection” and insert -- a fluid viscosity -- and -- a fluid injection --, respectively, therefor.

Column 22,
Line 16, please delete “the wellbore” and insert -- a wellbore -- therefor.
Line 19, please delete “the upward” and insert -- an upward -- therefor.
Line 31, please delete “the annulus” and insert -- an annulus -- therefor.
Line 38, please delete “the” between “wherein” and “sand”.
Line 39, please delete “the” between “of” and “normally”.
Line 56, please delete “the surface” and insert -- a surface -- therefor.
Line 63, please delete “the magnitude” and insert -- a magnitude -- therefor.
Line 65, please delete “the average”and insert -- an average -- therefor.

Column 23,
Lines 9 and 12, please delete “24” and insert -- 25 -- therefor.
Line 24, please delete “wherein the” and insert -- wherein a -- therefor.
Lines 35 and 39, please delete “the ratio” and “the fracture”, and insert -- a ratio -- and -- a fracture --, respectively, therefor.
Line 36, please delete “the fracture” and insert -- a fracture -- therefor.
Line 40, please delete “the fracture” and “the fluid” and insert -- a fracture -- and -- a fluid --, respectively, therefor.
Lines 41 and 42, please delete “the fluid” and insert -- a fluid -- therefor.
Lines 48 and 54, please delete “frac” and insert -- fracturing -- therefor.
Line 51, please delete “fraction intending” and “systematically” and insert -- fracture extending -- and -- symmetrically --, respectively, therefor.
Line 53, please delete “the frac” and “so created” and insert -- a fracturing -- and -- is created --, respectively, therefor.

UNITED STATES PATENT AND TRADEMARK OFFICE

CERTIFICATE OF CORRECTION

PATENT NO. : 5,875,843
DATED : March 2, 1999
INVENTOR(S) : Hill

It is certified that error appears in the above-identified patent and that said Letters Patent is hereby corrected as shown below:

Column 23 (cont.),
Line 56, please delete “the” between “causes” and “mineral”.
Line 57, please delete “the formation” and insert -- a formation -- therefor.
Line 58, please delete “the same” and insert -- a same -- therefor.
Line 59, please delete “the” between “to” and “walls”.
Line 61, please delete “the outer” and insert -- an outer -- therefor.

Column 24,
Line 6, please insert -- a -- between “provide” and “by-pass”.
Line 10, please insert -- the -- between “in” and “fracture”.
Line 12, please delete “a fracturing” and insert -- the fracturing -- therefor.
Line 13, please delete “a fracture” and insert -- the fracture -- therefor.
Line 14, please delete “the total” and insert -- a total -- therefor.
Line 17, please delete “the ratio” and insert -- a ratio -- therefor.
Line 18, please delete “of the rate” and “to the rate” and insert -- of a rate -- and -- to a rate --, respectively, therefor.
Line 19, please delete “the injection” and insert -- an injection -- therefor.
Line 20, please delete “the fracturing” and insert -- a fracturing -- therefor.
Line 25, please delete “36” and insert -- 39 -- therefor.
Line 37, please delete “the same” and insert -- a same -- therefor.
Line 42, please delete “the removal” and insert -- a removal -- therefor.
Line 58, please delete “a zone” and insert -- the zone -- therefor.
Line 60, please delete “the initiation”and insert -- an initiation -- therefor.
Line 62, please delete “the interior” and insert -- an interior -- therefor.

Signed and Sealed this

Twenty-fifth Day of October, 2005

JON W. DUDAS
*Director of the United States Patent and Trademark Office*